US010762859B2

(12) United States Patent
Nakajima et al.

(10) Patent No.: US 10,762,859 B2
(45) Date of Patent: Sep. 1, 2020

(54) DISPLAY DEVICE AND DISPLAY METHOD

(71) Applicant: JVC KENWOOD CORPORATION, Yokohama-shi, Kanagawa (JP)

(72) Inventors: Nobuki Nakajima, Yokohama (JP); Takeshi Makabe, Yokohama (JP); Shunsuke Izawa, Yokohama (JP)

(73) Assignee: JVC KENWOOD CORPORATION, Yokohama-Shi, Kanagawa (JP)

( * ) Notice: Subject to any disclaimer, the term of this patent is extended or adjusted under 35 U.S.C. 154(b) by 0 days.

(21) Appl. No.: 15/939,951

(22) Filed: Mar. 29, 2018

(65) Prior Publication Data

US 2018/0336853 A1 Nov. 22, 2018

(30) Foreign Application Priority Data

May 17, 2017 (JP) ..... 2017-097954
May 17, 2017 (JP) ..... 2017-097955

(51) Int. Cl.
*G09G 3/36* (2006.01)
*G09G 3/20* (2006.01)

(52) U.S. Cl.
CPC ..... *G09G 3/3607* (2013.01); *G09G 3/2051* (2013.01); *G09G 3/3648* (2013.01); *G09G 2320/0209* (2013.01); *G09G 2320/0233* (2013.01); *G09G 2320/0238* (2013.01); *G09G 2320/0271* (2013.01); *G09G 2320/066* (2013.01); *G09G 2360/16* (2013.01)

(58) Field of Classification Search
USPC ..... 345/76–81, 87–89
See application file for complete search history.

(56) References Cited

U.S. PATENT DOCUMENTS

2009/0109210 A1* 4/2009 Ito ..... G09G 3/3648 345/214
2014/0043318 A1* 2/2014 Choo ..... G09G 5/00 345/214
2015/0279281 A1* 10/2015 Nakahata ..... G09G 3/3233 345/690
2016/0210897 A1* 7/2016 Jun ..... G09G 3/3233
2017/0102342 A1* 4/2017 Iwami ..... G06F 3/044

FOREIGN PATENT DOCUMENTS

JP 2014-2232 A 1/2014

* cited by examiner

*Primary Examiner* — Roy P Rabindranath
(74) *Attorney, Agent, or Firm* — Nath, Goldberg & Meyer; Jerald L. Meyer

(57) ABSTRACT

A display device includes a display pixel unit and a signal processing unit. The display pixel unit includes a plurality of pixels arranged in a horizontal direction and a vertical direction. The signal processing unit determines a correction value corresponding to a target pixel based on differences between gradation data of the target pixel and gradation data of peripheral pixels disposed in the horizontal direction, the vertical direction, and an oblique direction with respect to the target pixel, respectively, among the plurality of pixels, increases or decreases a pixel value of the target pixel based on the correction value, and corrects the gradation data of the target pixel to reduce the differences.

9 Claims, 15 Drawing Sheets

| | (m−2)−TH COLUMN | (m−1)−TH COLUMN | m−TH COLUMN | (m+1)−TH COLUMN | (m+2)−TH COLUMN |
|---|---|---|---|---|---|
| (n−2)−TH ROW | 60n−2_m−2<br>gr_n−2_m−2 | 60n−2_m−1<br>gr_n−2_m−1 | 60n−2_m<br>gr_n−2_m | 60n−2_m+1<br>gr_n−2_m+1 | 60n−2_m+2<br>gr_n−2_m+2 |
| (n−1)−TH ROW | 60n−1_m−2<br>gr_n−1_m−2 | 60n−1_m−1<br>gr_n−1_m−1 | 60n−1_m<br>gr_n−1_m | 60n−1_m+1<br>gr_n−1_m+1 | 60n−1_m+2<br>gr_n−1_m+2 |
| n−TH ROW | 60n_m−2<br>gr_n_m−2 | 60n_m−1<br>gr_n_m−1 | 60n_m<br>gr_n_m | 60n_m+1<br>gr_n_m+1 | 60n_m+2<br>gr_n_m+2 |
| (n+1)−TH ROW | 60n+1_m−2<br>gr_n+1_m−2 | 60n+1_m−1<br>gr_n+1_m−1 | 60n+1_m<br>gr_n+1_m | 60n+1_m+1<br>gr_n+1_m+1 | 60n+1_m+2<br>gr_n+1_m+2 |
| (n+2)−TH ROW | 60n+2_m−2<br>gr_n+2_m−2 | 60n+2_m−1<br>gr_n+2_m−1 | 60n+2_m<br>gr_n+2_m | 60n+2_m+1<br>gr_n+2_m+1 | 60n+2_m+2<br>gr_n+2_m+2 |

FIG. 2

| | (m−2)−TH COLUMN | (m−1)−TH COLUMN | m−TH COLUMN | (m+1)−TH COLUMN | (m+2)−TH COLUMN |
|---|---|---|---|---|---|
| (n−2)−TH ROW | 60n−2_m−2<br>gr_n−2_m−2 | 60n−2_m−1<br>gr_n−2_m−1 | 60n−2_m<br>gr_n−2_m | 60n−2_m+1<br>gr_n−2_m+1 | 60n−2_m+2<br>gr_n−2_m+2 |
| (n−1)−TH ROW | 60n−1_m−2<br>gr_n−1_m−2 | 60n−1_m−1<br>gr_n−1_m−1 | 60n−1_m<br>gr_n−1_m | 60n−1_m+1<br>gr_n−1_m+1 | 60n−1_m+2<br>gr_n−1_m+2 |
| n−TH ROW | 60n_m−2<br>gr_n_m−2 | 60n_m−1<br>gr_n_m−1 | 60n_m<br>gr_n_m | 60n_m+1<br>gr_n_m+1 | 60n_m+2<br>gr_n_m+2 |
| (n+1)−TH ROW | 60n+1_m−2<br>gr_n+1_m−2 | 60n+1_m−1<br>gr_n+1_m−1 | 60n+1_m<br>gr_n+1_m | 60n+1_m+1<br>gr_n+1_m+1 | 60n+1_m+2<br>gr_n+1_m+2 |
| (n+2)−TH ROW | 60n+2_m−2<br>gr_n+2_m−2 | 60n+2_m−1<br>gr_n+2_m−1 | 60n+2_m<br>gr_n+2_m | 60n+2_m+1<br>gr_n+2_m+1 | 60n+2_m+2<br>gr_n+2_m+2 |

FIG. 3

| | (m−2)−TH COLUMN | (m−1)−TH COLUMN | m−TH COLUMN | (m+1)−TH COLUMN | (m+2)−TH COLUMN |
|---|---|---|---|---|---|
| (n−2)−TH ROW | 0 | 0 | 0 | 255 | 255 |
| (n−1)−TH ROW | 0 | 0 | 0 | 255 | 255 |
| n−TH ROW | 0 | 0 | 0 | 255 | 255 |
| (n+1)−TH ROW | 0 | 0 | 0 | 255 | 255 |
| (n+2)−TH ROW | 0 | 0 | 0 | 255 | 255 |

FIG. 4

| | (m−2)−TH COLUMN | (m−1)−TH COLUMN | m−TH COLUMN | (m+1)−TH COLUMN | (m+2)−TH COLUMN |
|---|---|---|---|---|---|
| (n−2)−TH ROW | 0 | 31 | 62 | 255 | 255 |
| (n−1)−TH ROW | 0 | 31 | 62 | 255 | 255 |
| n−TH ROW | 0 | 31 | 62 | 255 | 255 |
| (n+1)−TH ROW | 0 | 31 | 62 | 255 | 255 |
| (n+2)−TH ROW | 0 | 31 | 62 | 255 | 255 |

FIG. 5

| | (m−2)−TH COLUMN | (m−1)−TH COLUMN | m−TH COLUMN | (m+1)−TH COLUMN | (m+2)−TH COLUMN |
|---|---|---|---|---|---|
| (n−2)−TH ROW | 0 | 15 | 46 | 255 | 255 |
| (n−1)−TH ROW | 0 | 15 | 46 | 255 | 255 |
| n−TH ROW | 0 | 15 | 46 | 255 | 255 |
| (n+1)−TH ROW | 0 | 15 | 46 | 255 | 255 |
| (n+2)−TH ROW | 0 | 15 | 46 | 255 | 255 |

FIG. 6

| | (m−2)−TH COLUMN | (m−1)−TH COLUMN | m−TH COLUMN | (m+1)−TH COLUMN | (m+2)−TH COLUMN |
|---|---|---|---|---|---|
| (n−2)−TH ROW | 0 | 7 | 38 | 255 | 255 |
| (n−1)−TH ROW | 0 | 7 | 38 | 255 | 255 |
| n−TH ROW | 0 | 7 | 38 | 255 | 255 |
| (n+1)−TH ROW | 0 | 7 | 38 | 255 | 255 |
| (n+2)−TH ROW | 0 | 7 | 38 | 255 | 255 |

FIG. 7

| | (m−2)−TH COLUMN | (m−1)−TH COLUMN | m−TH COLUMN | (m+1)−TH COLUMN | (m+2)−TH COLUMN |
|---|---|---|---|---|---|
| (n−2)−TH ROW | 0 | 0 | 0 | 0 | 0 |
| (n−1)−TH ROW | 0 | 0 | 0 | 0 | 255 |
| n−TH ROW | 0 | 0 | 0 | 255 | 255 |
| (n+1)−TH ROW | 0 | 0 | 255 | 255 | 255 |
| (n+2)−TH ROW | 0 | 255 | 255 | 255 | 255 |

| | (m−2)−TH COLUMN | (m−1)−TH COLUMN | m−TH COLUMN | (m+1)−TH COLUMN | (m+2)−TH COLUMN |
|---|---|---|---|---|---|
| (n−2)−TH ROW | 0 | 15 | 15 | 46 | 46 |
| (n−1)−TH ROW | 15 | 15 | 46 | 46 | 255 |
| n−TH ROW | 15 | 46 | 46 | 255 | 255 |
| (n+1)−TH ROW | 46 | 46 | 255 | 255 | 255 |
| (n+2)−TH ROW | 46 | 255 | 255 | 255 | 255 |

| | (m−2)−TH COLUMN | (m−1)−TH COLUMN | m−TH COLUMN | (m+1)−TH COLUMN | (m+2)−TH COLUMN |
|---|---|---|---|---|---|
| (n−2)−TH ROW | 0 | 47 | 94 | 255 | 255 |
| (n−1)−TH ROW | 0 | 47 | 94 | 255 | 255 |
| n−TH ROW | 0 | 47 | 94 | 255 | 255 |
| (n+1)−TH ROW | 0 | 47 | 94 | 255 | 255 |
| (n+2)−TH ROW | 0 | 47 | 94 | 255 | 255 |

| | (m−2)−TH COLUMN | (m−1)−TH COLUMN | m−TH COLUMN | (m+1)−TH COLUMN | (m+2)−TH COLUMN |
|---|---|---|---|---|---|
| (n−2)−TH ROW | 0 | 31 | 94 | 255 | 255 |
| (n−1)−TH ROW | 0 | 31 | 94 | 255 | 255 |
| n−TH ROW | 0 | 31 | 94 | 255 | 255 |
| (n+1)−TH ROW | 0 | 31 | 94 | 255 | 255 |
| (n+2)−TH ROW | 0 | 31 | 94 | 255 | 255 |

FIG. 14

| | (m−2)−TH COLUMN | (m−1)−TH COLUMN | m−TH COLUMN | (m+1)−TH COLUMN | (m+2)−TH COLUMN |
|---|---|---|---|---|---|
| (n−2)−TH ROW | 0 | 31 | 94 | 255 | 255 |
| (n−1)−TH ROW | 0 | 31 | 94 | 255 | 255 |
| n−TH ROW | 0 | 31 | 94 | 255 | 255 |
| (n+1)−TH ROW | 0 | 31 | 94 | 255 | 255 |
| (n+2)−TH ROW | 0 | 31 | 94 | 255 | 255 |

FIG. 15

| | (m−2)−TH COLUMN | (m−1)−TH COLUMN | m−TH COLUMN | (m+1)−TH COLUMN | (m+2)−TH COLUMN |
|---|---|---|---|---|---|
| (n−2)−TH ROW | 0 | 0 | 0 | 0 | 31 |
| (n−1)−TH ROW | 0 | 0 | 0 | 31 | 255 |
| n−TH ROW | 0 | 0 | 31 | 255 | 255 |
| (n+1)−TH ROW | 0 | 31 | 255 | 255 | 255 |
| (n+2)−TH ROW | 31 | 255 | 255 | 255 | 255 |

FIG. 16

| | (m−2)−TH COLUMN | (m−1)−TH COLUMN | m−TH COLUMN | (m+1)−TH COLUMN | (m+2)−TH COLUMN |
|---|---|---|---|---|---|
| (n−2)−TH ROW | 0 | 0 | 0 | 31 | 31 |
| (n−1)−TH ROW | 0 | 0 | 31 | 31 | 255 |
| n−TH ROW | 0 | 31 | 31 | 255 | 255 |
| (n+1)−TH ROW | 31 | 31 | 255 | 255 | 255 |
| (n+2)−TH ROW | 31 | 255 | 255 | 255 | 255 |

DISPLAY DEVICE AND DISPLAY METHOD

CROSS REFERENCE TO RELATED APPLICATION

This application is based upon and claims the benefit of priority under 35 U.S.C. § 119 from Japanese Patent Application No. 2017-097955, filed on May 17, 2017, and Japanese Patent Application No. 2017-097954, filed on May 17, 2017, the entire contents of which are incorporated herein by reference.

BACKGROUND

The present disclosure relates to a display device and display method which can prevent an occurrence of disclination when displaying an image.

Examples of a display device may include a liquid crystal device having a display pixel unit in which a plurality of pixels are arranged in horizontal and vertical directions. The liquid display device can perform gradation display of an image by driving liquid crystal based on gradation data of each pixel. An example of the liquid crystal display device is described in Japanese Unexamined Patent Application Publication No. 2014-2232.

SUMMARY

Recently, liquid crystal display devices have been improved in resolution so as to be referred to as 4K liquid crystal display devices in which the number of pixels in the horizontal direction is 4,096 or 3,840, and the number of pixels in the vertical direction is 2,400 or 2,160. The improvement in resolution tends to reduce a pixel pitch. The reduction of the pixel pitch may easily cause disclination.

The disclination is caused by a potential difference between adjacent pixels, and thus orients liquid crystal molecules in a direction different from a desired direction. The disclination serves as a factor that degrades the quality of a display image. In a liquid crystal display device using a vertical alignment liquid crystal, the vertical alignment property is degraded when a pretilt angle is increased. Thus, a black level may be raised to lower the contrast of the displayed image. Therefore, by decreasing the pretilt angle, it is possible to increase the contrast. However, when the pretilt angle is excessively decreased, disclination may easily occur.

A first aspect of one or more embodiments provides a display device including: a display pixel unit in which a plurality of pixels are arranged in a horizontal direction and a vertical direction; and a signal processing unit configured to determine a correction value corresponding to a target pixel based on differences between gradation data of the target pixel and gradation data of peripheral pixels disposed in the horizontal direction, the vertical direction, and an oblique direction with respect to the target pixel, respectively, among the plurality of pixels, increase or decrease a pixel value of the target pixel based on the correction value, and thus correct the gradation data of the target pixel to reduce the differences.

A second aspect of one or more embodiments provides a display method including: determining a correction value corresponding to a target pixel, based on differences between gradation data of the target pixel and gradation data of peripheral pixels disposed in a horizontal direction, a vertical direction, and an oblique direction with respect to the target pixel, respectively, among a plurality of pixels arranged in the horizontal direction and the vertical direction; and increasing or decreasing a pixel value of the target pixel based on the correction value, and thus correcting the gradation data of the target pixel to reduce the differences.

A third aspect of one or more embodiments provides a display device including: a display pixel unit having a plurality of pixels arranged therein; and a signal processing unit configured to determine a correction value corresponding to a target pixel based on a difference between gradation data of the target pixel and gradation data of a first peripheral pixel adjacent to the target pixel and a second peripheral pixel adjacent to the first peripheral pixel among the plurality of pixels, increase or decrease a pixel value of the target pixel based on the correction value, and thus correct the gradation data of the target pixel to reduce the difference.

A fourth aspect of one or more embodiments provides a display method including: determining a correction value corresponding to a target pixel, based on a difference between gradation data of the target pixel and gradation data of a first peripheral pixel adjacent to the target pixel and a second peripheral pixel adjacent to the first peripheral pixel among a plurality of pixels; and increasing or decreasing a pixel value of the target pixel based on the correction value, and thus correcting the gradation data of the target pixel to reduce the difference.

BRIEF DESCRIPTION OF THE DRAWINGS

FIG. 2 schematically illustrates a part of a display pixel unit.

FIG. 3 illustrates an example of gradation data of pixels in video data.

FIG. 4 illustrates an example in which the gradation data of the pixels are corrected.

FIG. 5 illustrates an example in which the gradation data of the pixels are corrected.

FIG. 6 illustrates an example in which the gradation data of the pixels are corrected.

FIG. 7 illustrates an example of gradation data of pixels in video data.

FIG. 14 illustrates an example in which the gradation data of the pixels are corrected.

FIG. 15 illustrates an example in which the gradation data of the pixels are corrected.

FIG. 16 illustrates an example in which the gradation data of the pixels are corrected.

DETAILED DESCRIPTION

First Embodiment

Figure 1:
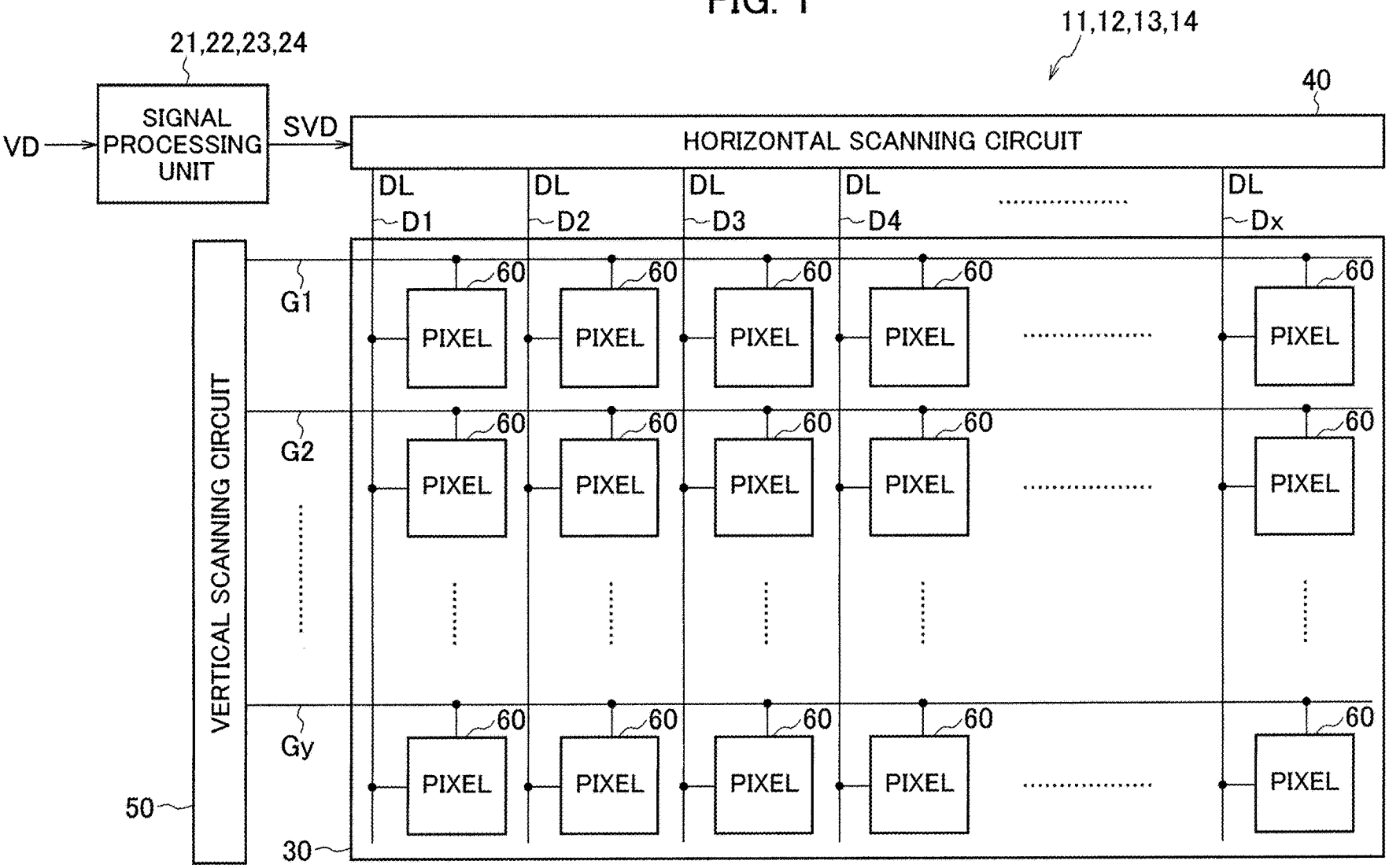
FIG. 1 is a configuration diagram illustrating display devices according to first to fourth embodiments.

Referring to FIG. 1, a display device according to a first embodiment will be described. The display device 11 includes a signal processing unit 21, a display pixel unit 30, a horizontal scanning circuit 40, and a vertical scanning circuit 50.

The signal processing unit 21 may be composed of either hardware (a circuit) or software (a computer program), or may be composed of a combination of hardware and software.

The display pixel unit 30 has a plurality (xxy) of pixels 60 arranged in a matrix shape at the respective intersections between a plurality (x) of column data lines D1 to Dx arranged in the horizontal direction, and a plurality (y) of row scanning lines G1 to Gy arranged in the vertical direction. That is, the plurality of pixels 60 are arranged in the horizontal direction and the vertical direction in the display pixel unit 30. The pixels 60 are connected to the respective column data lines D1 to Dx, and connected to the respective row scanning lines G1 to Gy.

The signal processing unit 21 receives video data VD as a digital signal. The signal processing unit 21 generates gradation corrected video data SVD by performing gradation correction on a pixel basis, based on the video data VD, and outputs the gradation corrected video data SVD to the horizontal scanning circuit 40. A specific gradation correction method for the video data VD through the signal processing unit 21 will be described later.

The horizontal scanning circuit 40 is connected to the pixels 60 of the display pixel unit 30 through the column data lines D. For example, the column data line D1 is connected to y pixels 60 at the first column of the display pixel unit 30. The column data line D2 is connected to y pixels 60 at the second column of the display pixel unit 30, and the column data line Dx is connected to y pixels 60 of the x-th column of the display pixel unit 30.

The horizontal scanning circuit 40 sequentially receives the gradation corrected video data SVD as gradation signals DL corresponding to x pixels 60 of one row scanning line G for one horizontal scanning period. The gradation signal DL has n-bit gradation data. For example, when n is set to 8, the display pixel unit 30 can display an image at 256 gradations for each of the pixels 60.

The horizontal scanning circuit 40 sequentially shifts the n-bit gradation data in parallel, and outputs the shifted data to the column data lines D1 to Dx. When the display pixel unit 30 is a 4K-resolution (x=4,096) liquid crystal panel, for example, the horizontal scanning circuit 40 sequentially shifts n-bit gradation data corresponding to 4,096 pixels 60, respectively, and outputs the shifted data to the column data lines D1 to Dx, for one horizontal scanning period.

The vertical scanning circuit 50 is connected to the pixels 60 of the display pixel unit 30 through the row scanning lines G. For example, the row scanning line G1 is connected to x pixels 60 at the first row of the display pixel unit 30, and the row scanning line G2 is connected to x pixels at the second row of the display pixel unit 30. The row scanning line Gy is connected to x pixels 60 at the y-th row of the display pixel unit 30.

The vertical scanning circuit 50 sequentially selects the row scanning lines G from the row scanning line G1 to the row scanning line Gy one by one, on one horizontal scanning period basis. When the column data lines D are selected by the horizontal scanning circuit 40 and the row scanning lines G are selected by the vertical scanning circuit 50, gradation data corresponding to the pixels 60 selected in the display pixel unit 30 are applied as gradation driving voltages. Accordingly, the pixels 60 display gradations according to the voltage values of the applied gradation driving voltages. The display pixel unit 30 can perform gradation display of an image as all of the pixels 60 display gradations.

Referring to FIGS. 2 to 8, the gradation correction method for video data VD through the signal processing unit 21 will be described. FIG. 2 schematically illustrates a part of the display pixel unit 30 of FIG. 1. Specifically, FIG. 2 illustrates the pixels 60 of the (n−2)-th to (n+2)-th rows (n≥3) and the (m−2)-th to (m+2)-th columns (m≥3) in the display pixel unit 30 of FIG. 1.

In order to distinguish the respective pixels 60 from each other, the pixels 60 of the (m−2)-th to (m+2)-th columns at the (n−2)-th row are set to pixels 60*n*−2_m−2, 60*n*−2_m−1, 60*n*−2_m, 60*n*−2_m+1, and 60*n*−2_m+2. The pixels 60 of the (m−2)-th to (m+2)-th columns at the (n−1)-th row are set to pixels 60*n*−1_m−2, 60*n*−1_m−1, 60*n*−1_m, 60*n*−1_m+1, and 60*n*−1_m+2.

The pixels 60 of the (m−2)-th to (m+2)-th columns at the n-th row are set to pixels 60*n_m*−2, 60*n_m*−1, 60*n_m*, 60*n_m*+1, and 60*n_m*+2. The pixels 60 of the (m−2)-th to (m+2)-th columns at the (n+1)-th row are set to pixels 60*n*+1_m−2, 60*n*+1_m−1, 60*n*+1_m, 60*n*+1_m+1, and 60*n*+1_m+2. The pixels 60 of the (m−2)-th to (m+2)-th columns at the (n+2)-th row are set to pixels 60*n*+2_m−2, 60*n*+2_m−1, 60*n*+2_m, 60*n*+2_m+1, and 60*n*+2_m+2.

In the video data VD, the gradation data corresponding to the pixels 60*n*−2_m−2, 60*n*−2_m−1, 60*n*−2_m, 60*n*−2_m+1, and 60*n*−2_m+2 are set to gradation data gr_n−2_m−2, gr_n−2_m−1, gr_n−2_m, gr_n−2_m+1, and gr_n−2 m+2. The gradation data corresponding to the pixels 60*n*−1_m−2, 60*n*−1_m−1, 60*n*−1_m, 60*n*−1_m+1, and 60*n*−1_m+2 are set to gradation data gr_n−1_m−2, gr_n−1_m−1, gr_n−1_m, gr_n−1_m+1, and gr_n−1_m+2.

The gradation data corresponding to the pixels 60*n_m*−2, 60*n_m*−1, 60*n_m*, 60*n_m*+1, and 60*n_m*+2 are set to gradation data gr_n_m−2, gr_n_m−1, gr_n_m, gr_n_m+1, and gr_n_m+2. The gradation data corresponding to the pixels

60*n*+1_m−2, 60*n*+1_m−1, 60*n*+1_m, 60*n*+1_m+1, and 60*n*+1_m+2 are set to gradation data gr_n+1_m−2, gr_n+1_m−1, gr_n+1_m, gr_n+1_m+1, and gr_n+1_m+2.

The gradation data corresponding to the pixels 60*n*+2_m−2, 60*n*+2_m−1, 60*n*+2_m, 60*n*+2_m+1, and 60*n*+2_m+2 are set to gradation data gr_n+2_m−2, gr_n+2_m−1, gr_n+2_m, gr_n+2_m+1, and gr_n+2_m+2.

The signal processing unit 21 performs a gradation correction process on the gradation data inputted to the respective pixels 60. Specifically, the signal processing unit 21 calculates a difference between the gradation data of a target pixel and the gradation data of two peripheral pixels disposed in each of a horizontal direction, a vertical direction, and an oblique direction with respect to the target pixel, based on Equation (1). Then, the signal processing unit 21 specifies the maximum value from the calculation results, and sets the maximum value to a correction value CV for the target pixel.

the target pixel. Furthermore, a relation of α11=α12=α13=α14=α15=α16=α=17=α18 and a relation of β11=β12=β13=β14=β15=β16=β17=β18 may be applied.

For example, when the pixel 60*n_m* of the m-th column at the n-th row is set to the target pixel, the signal processing unit 21 calculates a difference between the gradation data of the target pixel and the gradation data of two peripheral pixels disposed in each of the horizontal direction, the vertical direction, and the oblique direction with respect to the pixel 60*n_m* set to the target pixel, based on Equation (1). Then, the signal processing unit 21 specifies the maximum value MAX from the calculation results, and sets the maximum value MAX to a correction value CV_n_m for the pixel 60*n_m*. In the following descriptions, the horizontal direction may be set to the right direction or the left direction, the vertical direction may be set to the top direction or the bottom direction, and the oblique direction $$\mathrm{CV_n_m} = \mathrm{MAX}\begin{pmatrix} \alpha 11\times(\mathrm{gr_n-1_m-gr_n_m})+\beta 11\times(\mathrm{gr_n-2_m-gr_n_m}), \\ \alpha 12\times(\mathrm{gr_n_m+1-gr_n_m})+\beta 12\times(\mathrm{gr_n_m+2-gr_n_m}), \\ \alpha 13\times(\mathrm{gr_n+1_m-gr_n_m})+\beta 13\times(\mathrm{gr_n+2_m-gr_n_m}), \\ \alpha 14\times(\mathrm{gr_n_m-1-gr_n_m})+\beta 14\times(\mathrm{gr_n_m-2-gr_n_m}), \\ \alpha 15\times(\mathrm{gr_n-1_m+1-gr_n_m})+\beta 15\times(\mathrm{gr_n-2_m+2-gr_n_m}), \\ \alpha 16\times(\mathrm{gr_n+1_m+1-gr_n_m})+\beta 16\times(\mathrm{gr_n+2_m+2-gr_n_m}), \\ \alpha 17\times(\mathrm{gr_n+1_m-1-gr_n_m})+\beta 17\times(\mathrm{gr_n+2_m-2-gr_n_m}), \\ \alpha 18\times(\mathrm{gr_n-1_m-1-gr_n_m})+\beta 18\times(\mathrm{gr_n-2_m-2-gr_n_m}) \end{pmatrix} \quad (1)$$

Here, α (α11 to α18) represents a correction coefficient (first correction coefficient) for a peripheral pixel 60 (first peripheral pixel) close to the target pixel between two pixels, and β (β11 to β18) represents a correction coefficient (second correction coefficient) for a peripheral pixel 60 (second peripheral pixel) far from the target pixel. The correction coefficients α and β are integers equal to or more than 0, respectively. The correction coefficients α and β are expressed through a relational expression of α=k×β (k≥1). That is, a weight equal to or more than that of the peripheral pixel 60 far from the target pixel is applied to the peripheral pixel 60 close to the target pixel.

The signal processing unit 21 determines the correction value CV corresponding to the target pixel, based on a difference between the gradation data of the target pixel and the gradation data of the first peripheral pixel adjacent to the target pixel and the second peripheral pixel adjacent to the first peripheral pixel among the plurality of pixels 60. The signal processing unit 21 increases the pixel value of the target pixel by adding the correction value CV to the gradation data of the target pixel, thereby decreasing the differences. The pixel value is a gradation value, for example.

The signal processing unit 21 calculates a difference between a plurality of peripheral pixels respectively disposed in the horizontal direction, the vertical direction, and the oblique direction of the target pixel, specifies the maximum value from the calculation results, and sets the maximum value to the correction value CV.

The signal processing unit 21 calculates the differences based on the correction coefficients α11 to α18 and β11 to β18 depending on the directions in which the peripheral pixels are disposed with respect to the target pixel or the distances between the target pixel and the peripheral pixels, specifies the maximum value from the calculation results, and sets the maximum value to the correction value CV for may be set to the top right direction, the bottom right direction, the bottom left direction, or the top left direction, in association with FIG. 2.

Specifically, the signal processing unit 21 calculates a difference between the gradation data of the pixel 60*n_m* and the gradation data of the peripheral pixels 60*n*−1_m and 60*n*−2_m disposed in the top direction with respect to the pixel 60*n_m* set to the target pixel, based on an operation expression of α11×(gr_n−1_m−gr_n_m)+β11×(gr_n−2_m−gr_n_m) in Equation (1). The signal processing unit 21 calculates a difference between the gradation data of the pixel 60*n_m* and the gradation data of the peripheral pixels 60*n_m*+1 and 60*n_m*+2 disposed in the right direction with respect to the pixel 60*n_m*, based on an operation expression of α12×(gr_n_m+1−gr_n_m)+β12×(gr_n_m+2−gr_n_m) in Equation (1).

The signal processing unit 21 calculates a difference between the gradation data of the pixel 60*n_m* and the gradation data of the peripheral pixels 60*n*+1_m and 60*n*+2_m disposed in the bottom direction with respect to the pixel 60*n_m*, based on an operation expression of α13×(gr_n+1_m−gr_n_m)+β13×(gr_n+2_m−gr_n_m)} in Equation (1). The signal processing unit 21 calculates a difference between the gradation data of the pixel 60*n_m* and the gradation data of the peripheral pixels 60*n_m*−1 and 60*n_m*−2 disposed in the left direction with respect to the pixel 60*n_m*, based on an operation expression of α14×(gr_n_m−1−gr_n_m)+β14×(gr_n_m−2−gr_n_m) in Equation (1). The signal processing unit 21 calculates a difference between the gradation data of the pixel 60*n_m* and the gradation data of the peripheral pixels 60*n*−1_m+1 and 60*n*−2_m+2 disposed in the top right direction with respect to the pixel 60*n_m*, based on an operation expression of α15×(gr_n−1_m+1−gr_n_m)+β15×(gr_n−2_m+2−gr_n_m) in Equation (1). The signal processing unit 21 calculates a difference between the gradation data of the pixel 60*n_m* and the gradation data of peripheral pixels 60*n*+1_m+1 and 60*n*+2_m+2 disposed in the bottom right direction with respect to the pixel 60*n_m*, based on an operation expression of $\alpha16\times(gr_n+1_m+1-gr_n_m)+\beta16\times(gr_n+2_m+2-gr_n_m)$ in Equation (1).

The signal processing unit 21 calculates a difference between the gradation data of the pixel 60*n_m* and the gradation data of the peripheral pixels 60*n*+1_m−1 and 60*n*+2_m−2 disposed in the bottom left direction with respect to the pixel 60*n_m*, based on an operation expression of $\alpha17\times(gr_n+1_m-1-gr_n_m)+\beta17\times(gr_n+2_m-2-gr_n_m)$ in Equation (1). The signal processing unit 21 calculates a difference between the gradation data of the pixel 60*n_m* and the gradation data of the peripheral pixels 60*n*−1_m−1 and 60*n*−2_m−2 disposed in the top left direction with respect to the pixel 60*n_m*, based on an operation expression of $\alpha18\times(gr_n-1_m-1-gr_n_m)+\beta18\times(gr_n-2_m-2-gr_n_m)\}$ in Equation (1).

The signal processing unit 21 specifies the maximum value MAX from the calculation results, and sets the maximum value MAX to the correction value CV_n_m for the pixel 60*n_m*. The signal processing unit 21 corrects the gradation data of the pixel 60*n_m* into gradation data obtained by adding the correction value CV_n_m to the gradation data gr_n_m of the pixel 60*n_m* in the video data VD. That is, the signal processing unit 21 determines the correction value CV corresponding to the target pixel, based on the difference between the gradation data of the target pixel and the gradation data of two peripheral pixels disposed in each of the horizontal direction, the vertical direction, and the oblique direction with respect to the target pixel among the plurality of pixels 60. The signal processing unit 21 increases the pixel value of the target pixel by adding the correction value CV to the gradation data of the target pixel, thereby decreasing the difference.

The signal processing unit 21 determines the correction value CV corresponding to the target pixel, based on the differences between the gradation data of the target pixel and the gradation data of the two peripheral pixels disposed in the right direction with respect to the target pixel, the gradation data of the two peripheral pixels disposed in the left direction with respect to the target pixel, the gradation data of the two peripheral pixels disposed in the top direction with respect to the target pixel, the gradation data of the two peripheral pixels disposed in the bottom direction with respect to the target pixel, the gradation data of the two peripheral pixels disposed in the top right direction with respect to the target pixel, the gradation data of the two peripheral pixels disposed in the bottom right direction with respect to the target pixel, the gradation data of the two peripheral pixels disposed in the bottom left direction with respect to the target pixel, and the gradation data of the two peripheral pixels disposed in the top left direction with respect to the target pixel. The signal processing unit 21 increases the pixel value of the target pixel by adding the correction value CV to the gradation data of the target pixel, thereby decreasing the differences.

The signal processing unit 21 performs the same gradation correction process as the pixel 60*n_m* on the whole pixels 60 of the display pixel unit 30. The signal processing unit 21 generates the gradation corrected video data SVD by performing the gradation correction process on the whole pixels 60 in the video data VD, and outputs the gradation corrected video data SVD to the horizontal scanning circuit 40.

FIG. 3 illustrates the case in which the gradation data gr of the pixels 60 of the (m−2)-th to m-th columns in the video data VD are 0, and the gradation data gr of the pixels 60 of the (m+1)-th and (m+2)-th columns are 255, in association with FIG. 2. FIG. 3 shows only the gradation data gr of the respective pixels 60 for convenience of understanding of the relation among the gradation data gr of the respective pixels 60.

Hereafter, the case in which the pixel n_m is set to the target pixel, the relation of $\alpha11=\alpha12=\alpha13=\alpha14=\alpha15=\alpha16=\alpha=17=\alpha18$ and the relation of $\beta11=\beta12=\beta13=\beta14=\beta15=\beta16=\beta17=\beta18$ are established, and the value calculated by $\alpha12\times(gr_n_m+1-gr_n_m)+\beta12\times(gr_n_m+2-gr_n_m)$ of Equation (1) becomes the maximum value will be described as follows.

FIG. 4 shows the gradation data gr of the respective pixels 60 when the correction coefficients α11 to α18 are set to 31 and the correction coefficients β11 to β18 are set to 31, for example, in association with FIG. 3. The signal processing unit 21 corrects the gradation data gr of the pixel 60*n_m* to 62. The signal processing unit 21 corrects the gradation data gr of the pixels 60 of the m-th column to 62 in the same manner as the pixel 60*n_m*. When the pixel 60*n_m*−1 of the (m−1)-th column at the n-th row is set to the target pixel, the signal processing unit 21 corrects the gradation data gr of the pixel 60*n_m*−1 to 31. The signal processing unit 21 corrects the gradation data gr of the pixels 60 of the (m−1)-th column to 31 in the same manner as the pixel 60*n_m*−1.

The verification result of the present inventor shows that, when the correction coefficients α11 to α18 are set to 31 and the correction coefficients β11 to β18 are set to 31, the gradations are excessively corrected. Therefore, an occurrence of disclination is prevented, but a reduction in contrast is found.

FIG. 5 shows the gradation data gr of the respective pixels 60 when the correction coefficients α11 to α18 are set to 31 and the correction coefficients β11 to β18 are set to 15, for example, in association with FIG. 3. The signal processing unit 21 corrects the gradation data gr of the pixel 60*n_m* to 46. The signal processing unit 21 corrects the gradation data gr of the pixels 60 of the m-th column to 46 in the same manner as the pixel 60*n_m*. When the pixel 60*n_m*−1 of the (m−1)-th column at the n-th row is set to the target pixel, the signal processing unit 21 corrects the gradation data gr of the pixel 60*n_m*−1 to 15. The signal processing unit 21 corrects the gradation data gr of the pixels 60 of the (m−1)-th column to 15 in the same manner as the pixel 60*n_m*−1.

The verification result of the present inventor shows that, when the correction coefficients α11 to α18 are set to 31 and the correction coefficients β11 to β18 are set to 15, a reduction in contrast and an occurrence of disclination are prevented.

FIG. 6 shows the gradation data gr of the respective pixels 60 when the correction coefficients α11 to α18 are set to 31 and the correction coefficients β11 to β18 are set to 7, for example, in association with FIG. 3. The signal processing unit 21 corrects the gradation data gr of the pixel 60*n_m* to 38. The signal processing unit 21 corrects the gradation data gr of the pixels 60 of the m-th column to 38 in the same manner as the pixel 60*n_m*. When the pixel 60*n_m*−1 of the (m−1)-th column at the n-th row is set to the target pixel, the signal processing unit 21 corrects the gradation data gr of the pixel 60*n_m*−1 to 7. The signal processing unit 21 corrects the gradation data gr of the pixels 60 of the (m−1)-th column to 7 in the same manner as the pixel 60*n_m*−1.

The verification result of the present inventor shows that, when the correction coefficients α11 to α18 are set to 31 and the correction coefficients β11 to β18 are set to 7, the gradation correction is insufficiently performed. Therefore, a reduction in contrast is prevented, but an occurrence of disclination cannot be sufficiently prevented.

Accordingly, in the relational expression of $\alpha=k\times\beta$, the coefficient k may be set to about 2. Moreover, the correction coefficients $\alpha$ and $\beta$ and the coefficient k may be properly determined according to the configuration, the resolution, the pixel pitch and the like of the display pixel unit 30.

FIG. 7 illustrates the case in which the gradation data gr of the pixels 60 in the top left area of FIG. 7 are 0 and the gradation data gr of the pixels 60 in the bottom right area of FIG. 7 are 255 in the video data VD, in association with FIG. 2. FIG. 7 shows only the gradation data gr of the respective pixels 60, for the convenience of understanding the relation among the gradation data gr of the respective pixels 60.

Hereafter, the case in which the pixel n_m is set to the target pixel, the relation of $\alpha11=\alpha12=\alpha13=\alpha14=\alpha15=\alpha16=\alpha=17=\alpha18$ and the relation of $\beta11=\beta12=\beta13=\beta14=\beta15=\beta16=\beta17=\beta18$ are established, and the value calculated by $\alpha16\times(gr_n+1_m+1-gr_n_m)+\beta16\times(gr_n+2_m+2-gr_n_m)$ in Equation (1) becomes the maximum value will be described as follows.

Figures 8, 9:
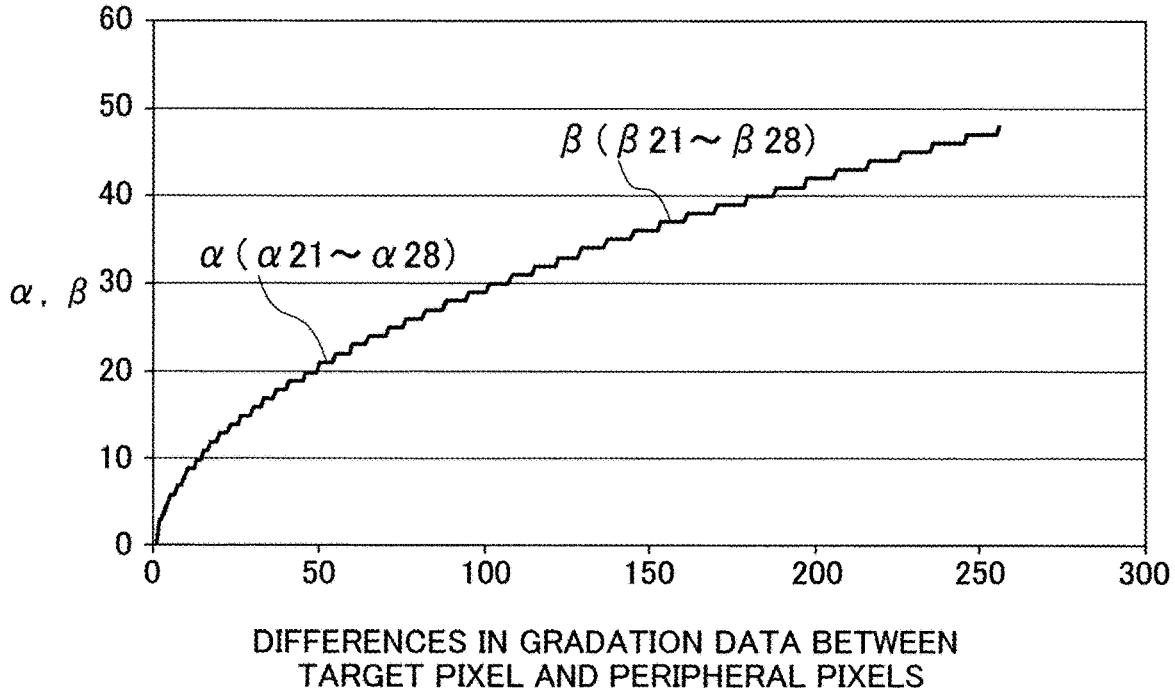
FIG. 8 illustrates an example in which the gradation data of the pixels are corrected.
FIG. 9 illustrates the relation between correction coefficients and differences in gradation data between peripheral pixels and a target pixel.

FIG. 8 shows the gradation data gr of the respective pixels 60 when the correction coefficients $\alpha11$ to $\alpha18$ are set to 31 and the correction coefficients $\beta11$ to $\beta18$ are set to 15, for example, in association with FIG. 7. The signal processing unit 21 corrects the gradation data gr of the pixels 60*n_m*, 60*n*−2_m+1, 60*n*−2_m+2, 60*n*−1_m, 60*n*−1_m+1, 60*n_m*−1, 60*n*+1_m−2, 60*n*+1_m−1, and 60*n*+2_m−2 to 46. The signal processing unit 21 corrects the gradation data gr of the pixels 60*n*−2_m−1, 60*n*−2_m, 60*n*−1_m−2, 60*n*−1_m−1, and 60*n_m*−2 to 15.

When gradation correction is performed based on two peripheral pixels disposed in each of the horizontal direction and the vertical direction with respect to the target pixel, that is when gradation correction is not performed in the oblique direction, the gradation data gr of the pixels 60*n*−2_m+1, 60*n*−1_m, 60*n_m*−1, and 60*n*+1_m−2 are corrected to 15.

On the other hand, when gradation correction is performed based on two peripheral pixels disposed in each of the horizontal direction, the vertical direction, and the oblique direction with respect to the target pixel, a value obtained by performing an operation on the gradation data of the two peripheral pixels disposed in the oblique direction with respect to the target pixel becomes the maximum value in the image pattern of FIG. 7. Therefore, the gradation data gr of the pixels 60*n*−2_m+1, 60*n*−1_m, 60*n_m*−1, and 60*n*+1_m−2 are corrected to 46.

Furthermore, when gradation correction is performed based on two peripheral pixels disposed in each of the horizontal direction and the vertical direction with respect to the target pixel, the gradation data gr of the pixels 60*n*−2_m, 60*n*−2_m−1, 60*n*−1_m−1, 60*n*−1_m−2, and 60*n_m*−2 are corrected to 0.

On the other hand, when gradation correction is performed based on two peripheral pixels disposed in each of the horizontal direction, the vertical direction, and the oblique direction with respect to the target pixel, a value obtained by performing an operation on the gradation data of two peripheral pixels disposed in the oblique direction with respect to the target pixel becomes the maximum value in the image pattern of FIG. 7. Therefore, the gradation data gr of the pixels 60*n*−2_m, 60*n*−2_m−1, 60*n*−1_m−1, 60*n*−1_m−2, and 60*n_m*−2 are corrected to 15.

Therefore, the display device 11 and the display method according to a first embodiment can perform gradation correction based on the difference between the gradation data of the target pixel and the gradation data of two peripheral pixels disposed in each of the horizontal direction, the vertical direction, and the oblique direction with respect to the target pixel, such that the difference in gradation data between the target pixel and the peripheral pixels can be reduced for two peripheral pixels, which makes it possible to prevent an occurrence of disclination.

Furthermore, since the display device 11 and the display method according to a first embodiment can perform gradation correction based on the difference between the gradation data of the target pixel and the gradation data of two peripheral pixels disposed in each of the horizontal direction, the vertical direction, and the oblique direction with respect to the target pixel, the display device 11 and the display method can prevent an occurrence of disclination in various image patterns, compared to when gradation correction is performed based on the difference between the gradation data of the target pixel and the gradation data of two peripheral pixels disposed in each of the horizontal direction and the vertical direction.

The direction in which disclination easily occurs may differ depending on the design specification of the display device 11 or each of the display devices 11. The display device 11 and the display method according to a first embodiment perform gradation correction based on the difference between the gradation data of the target pixel and the gradation data of two peripheral pixels disposed in each of the horizontal direction, the vertical direction, and the oblique direction with respect to the target pixel. Therefore, the display device 11 and the display method can prevent an occurrence of disclination in various image patterns, even when the direction in which disclination easily occurs differ depending on the design specification of the display device 11 and each of the display devices 11.

Moreover, when the direction in which disclination easily occurs is confirmed in advance, the display device 11 and the display method may perform gradation correction based on a difference between the gradation data of the target pixel and the gradation data of only two peripheral pixels disposed in the direction in which disclination easily occurs, with respect to the target pixel.

Second Embodiment

As illustrated in FIG. 1, a display device 12 according to a second embodiment includes a signal processing unit 22 instead of the signal processing unit 21, and a display method through the signal processing unit 22, specifically a gradation correction method for video data VD is different from the display method through the signal processing unit 21. Therefore, the gradation correction method for video data VD through the signal processing unit 22 will be described. For convenience of description, the same components as those of the display device 11 according to a first embodiment are represented by the same reference numerals.

The signal processing unit 22 performs a gradation correction process on gradation data inputted to the respective pixels 60. Specifically, the signal processing unit 22 calculates a difference between the gradation data of a target pixel and the gradation data of two peripheral pixels disposed in a horizontal direction, a vertical direction, and an oblique direction with respect to the target pixel, based on Equation (2). Then, the signal processing unit 22 specifies the maximum value from the calculation results, and sets the maximum value to a correction value CV for the target pixel.

$$CV_n_m = MAX\begin{pmatrix} \alpha 21 \times (gr_n-1_m-gr_n_m) + \beta 21 \times (gr_n-2_m-gr_n_m), \\ \alpha 22 \times (gr_n_m+1-gr_n_m) + \beta 22 \times (gr_n_m+2-gr_n_m), \\ \alpha 23 \times (gr_n+1_m-gr_n_m) + \beta 23 \times (gr_n+2_m-gr_n_m), \\ \alpha 24 \times (gr_n_m-1-gr_n_m) + \beta 24 \times (gr_n_m-2-gr_n_m), \\ \alpha 25 \times (gr_n-1_m+1-gr_n_m) + \beta 25 \times (gr_n-2_m+2-gr_n_m), \\ \alpha 26 \times (gr_n+1_m+1-gr_n_m) + \beta 26 \times (gr_n+2_m+2-gr_n_m), \\ \alpha 27 \times (gr_n+1_m-1-gr_n_m) + \beta 27 \times (gr_n+2_m-2-gr_n_m), \\ \alpha 28 \times (gr_n-1_m-1-gr_n_m) + \beta 28 \times (gr_n-2_m-2-gr_n_m) \end{pmatrix} \quad (2)$$

Here, α (α21 to α28) represents a correction coefficient (first correction coefficient) for a peripheral pixel 60 (first peripheral pixel) close to the target pixel between two pixels, and β (β21 to β28) represents a correction coefficient (second correction coefficient) for a peripheral pixel 60 (second peripheral pixel) far from the target pixel. The correction coefficients α and β are variables equal to or more than 0, respectively. The correction coefficients α and β are expressed as a relational expression of α=k×β (k≥1). That is, a weight equal to or more than that of the peripheral pixel 60 far from the target pixel is applied to the peripheral pixel 60 close to the target pixel.

The signal processing unit 22 determines a correction value CV corresponding to the target pixel, based on a difference between the gradation data of the target pixel and the gradation data of the first peripheral pixel adjacent to the target pixel and the second peripheral pixel adjacent to the first peripheral pixel among the plurality of pixels 60. The signal processing unit 22 increases the pixel value of the target pixel by adding the correction value CV to the gradation data of the target pixel, thereby decreasing the difference. The pixel value is a gradation value, for example.

The signal processing unit 22 calculates a difference in a plurality of peripheral pixels disposed in each of the horizontal direction, the vertical direction, and the oblique direction with respect to the target pixel, specifies the maximum value from the calculation results, and sets the maximum value to the correction value CV.

The signal processing unit 22 calculates the difference based on the correction coefficients α21 to α28 and β21 to β28 depending on the direction in which the peripheral pixels are disposed with respect to the target pixel or the distances between the target pixel and the peripheral pixels, specifies the maximum value from the calculation results, and sets the maximum value to the correction value CV for the target pixel. Furthermore, a relation of α21=α22=α23=α24=α25=α26=α=27=α28 and a relation of β21=β22=β23=024=β25=β26=β27=β28 may be set.

For example, when the pixel 60*n_m* of the m-th column at the n-th row is set to the target pixel, the signal processing unit 22 calculates a difference between the gradation data of the pixel 60*n_m* and the gradation data of two peripheral pixels disposed in each of the horizontal direction, the vertical direction and the oblique direction with respect to the pixel 60*n_m* set to the target pixel, based on Equation (2). The signal processing unit 22 specifies the maximum value MAX from the calculation results, and sets the maximum value MAX to a correction value CV_n_m for the pixel 60*n_m*. In the following descriptions, the horizontal direction may be set to the right direction or the left direction, the vertical direction may be set to the top direction or the bottom direction, and the oblique direction may be set to the top right direction, the bottom right direction, the bottom left direction, or the top left direction.

Specifically, the signal processing unit 22 calculates a difference between the gradation data of the pixel 60*n_m* and the gradation data of the peripheral pixels 60*n*−1_m and 60*n*−2_m disposed in the top direction with respect to the pixel 60*n_m* set to the target pixel, based on an operation expression of α21×(gr_n−1_m−gr_n_m)+β21×(gr_n−2_m−gr_n_m)} in Equation (2). The signal processing unit 22 calculates a difference between the gradation data of the pixel 60*n_m* and the gradation data of the peripheral pixels 60*n_m*+1 and 60*n_m*+2 disposed in the right direction with respect to the pixel 60*n_m*, based on an operation expression of {α22×(gr_n_m+1−gr_n_m)+β22×(gr_n_m+2−gr_n_m)} in Equation (2).

The signal processing unit 22 calculates a difference between the gradation data of the pixel 60*n_m* and the gradation data of the peripheral pixels 60*n*+1_m and 60*n*+2_m disposed in the bottom direction with respect to the pixel 60*n_m*, based on an operation expression of α23×(gr_n+1_m−gr_n_m)+β23×(gr_n+2_m−gr_n_m) in Equation (2). The signal processing unit 22 calculates a difference between the gradation data of the pixel 60*n_m* and the gradation data of the peripheral pixels 60*n_m*−1 and 60*n_m*−2 disposed in the left direction with respect to the pixel 60*n_m*, based on an operation expression of α24×(gr_n_m−1−gr_n_m)+β24×(gr_n_m−2−gr_n_m) in Equation (2).

The signal processing unit 22 calculates a difference between the gradation data of the pixel 60*n_m* and the gradation data of the peripheral pixels 60*n*−1_m+1 and 60*n*−2_m+2 disposed in the top right direction with respect to the pixel 60*n_m*, based on an operation expression of α25×(gr_n−1_m+1−gr_n_m)+β25×(gr_n−2_m+2−gr_n_m) in Equation (2). The signal processing unit 22 calculates a difference between the gradation data of the pixel 60*n_m* and the gradation data of the peripheral pixels 60*n*+1_m+1 and 60*n*+2_m+2 disposed in the bottom right direction with respect to the pixel 60*n_m*, based on an operation expression of α26×(gr_n+1_m+1−gr_n_m)+β26×(gr_n+2_m+2−gr_n_m) in Equation (2).

The signal processing unit 22 calculates a difference between the gradation data of the pixel 60*n_m* and the gradation data of the peripheral pixels 60*n*+1_m−1 and 60*n*+2_m−2 disposed in the bottom left direction with respect to the pixel 60*n_m*, based on an operation expression of α27×(gr_n+1_m−1−gr_n_m)+β27×(gr_n+2_m−2−gr_n_m) in Equation (2). The signal processing unit 22 calculates a difference between the gradation data of the pixel 60*n_m* and the gradation data of the peripheral pixels 60*n*−1_m−1 and 60*n*−2_m−2 disposed in the top left direction with respect to the pixel 60*n_m*, based on an operation expression of α28×(gr_n−1_m−1−gr_n_m)+β28×(gr_n−2_m−2−gr_n_m) in Equation (2).

The signal processing unit 22 specifies the maximum value MAX from the calculation results, and sets the maximum value MAX to a correction value CV_n_m for the pixel 60*n_m*. The signal processing unit 22 corrects the gradation data of the pixel 60*n_m* into gradation data obtained by adding the correction value CV_n_m to the gradation data gr_n_m of the pixel 60*n_m* in the video data VD. That is, the signal processing unit 22 determines the correction value CV corresponding to the target pixel, based on the difference between the gradation data of the target pixel and the gradation data of two peripheral pixels disposed in each of the horizontal direction, the vertical direction, and the oblique direction with respect to the target pixel among the plurality of pixels 60. The signal processing unit 22 increases the pixel value of the target pixel by adding the correction value CV to the gradation data of the target pixel, thereby decreasing the difference.

The signal processing unit 22 determines the correction value CV corresponding to the target pixel, based on the differences between the gradation data of the target pixel and the gradation data of the two peripheral pixels disposed in the right direction with respect to the target pixel, the gradation data of the two peripheral pixels disposed in the left direction with respect to the target pixel, the gradation data of the two peripheral pixels disposed in the top direction with respect to the target pixel, the gradation data of the two peripheral pixels disposed in the bottom direction with respect to the target pixel, the gradation data of the two peripheral pixels disposed in the top right direction with respect to the target pixel, the gradation data of the two peripheral pixels disposed in the bottom right direction with respect to the target pixel, the gradation data of the two peripheral pixels disposed in the bottom left direction with respect to the target pixel, and the gradation data of the two peripheral pixels disposed in the top left direction with respect to the target pixel. The signal processing unit 22 increases the pixel value of the target pixel by adding the correction value CV to the gradation data of the target pixel, thereby decreasing the differences.

The signal processing unit 22 performs the same gradation correction process as the pixel 60*n_m* on the whole pixels 60 of the display pixel unit 30. The signal processing unit 22 generates gradation corrected video data SVD by performing the gradation correction process on the whole pixels 60 in the video data VD, and outputs the gradation corrected video data SVD to the horizontal scanning circuit 40.

The signal processing unit 22 sets the correction coefficients α and β based on the differences in gradation data between the peripheral pixels and the target pixel. For example, the signal processing unit 22 sets the correction coefficients α (α21 to α28) and the correction coefficients β (β21 to β28), based on a lookup table in which the differences in gradation data between the peripheral pixels and the target pixel are associated with the correction coefficients α (α21 to α28) and the correction coefficients β (β21 to β28). The lookup table may be stored in the signal processing unit 22, or stored in any memory unit except the signal processing unit 22.

Specifically, the signal processing unit 22 sets the correction coefficient α21 based on a gradation data difference (gr_n−1_m−gr_n_m) between the peripheral pixel 60*n*−1_m and the target pixel 60*n_m*. The signal processing unit 22 sets the correction coefficient α22 based on a gradation data difference (gr_n_m+1−gr_n_m) between the peripheral pixel 60*n_m*+1 and the target pixel 60*n_m*. The signal processing unit 22 sets the correction coefficient α23 based on a gradation data difference (gr_n+1_m−gr_n_m) between the peripheral pixel 60*n*+1_m and the target pixel 60*n_m*. The signal processing unit 22 sets the correction coefficient α24 based on a gradation data difference (gr_n_m−1−gr_n_m) between the peripheral pixel 60*n_m*−1 and the target pixel 60*n_m*.

The signal processing unit 22 sets the correction coefficient α25 based on a gradation data difference (gr_n−1_m+1 gr_n_m) between the peripheral pixel 60*n*−1_m+1 and the target pixel 60*n_m*. The signal processing unit 22 sets the correction coefficient α26 based on a gradation data difference (gr_n+1_m+1−gr_n_m) between the peripheral pixel 60*n*+1_m+1 and the target pixel 60*n_m*. The signal processing unit 22 sets the correction coefficient α27 based on a gradation data difference (gr_n+1_m−1−gr_n_m) between the peripheral pixel 60*n*+1_m−1 and the target pixel 60*n_m*. The signal processing unit 22 sets the correction coefficient α28 based on a gradation data difference (gr_n−1_m−1−gr_n_m) between the peripheral pixel 60*n*−1_m−1 and the target pixel 60*n_m*.

The signal processing unit 22 sets the correction coefficient β21 based on a gradation data difference (gr_n−2_m−gr_n_m) between the peripheral pixel 60*n*−2_m and the target pixel 60*n_m*. The signal processing unit 22 sets the correction coefficient β22 based on a gradation data difference (gr_n_m+2−gr_n_m) between the peripheral pixel 60*n_m*+2 and the target pixel 60*n_m*. The signal processing unit 22 sets the correction coefficient β23 based on a gradation data difference (gr_n+2_m−gr_n_m) between the peripheral pixel 60*n*+2_m and the target pixel 60*n_m*. The signal processing unit 22 sets the correction coefficient β24 based on a gradation data difference (gr_n_m−2−gr_n_m) between the peripheral pixel 60*n_m*−2 and the target pixel 60*n_m*.

The signal processing unit 22 sets the correction coefficient β25 based on a gradation data difference (gr_n−2_m+2−gr_n_m) between the peripheral pixel 60*n*−2_m+2 and the target pixel 60*n_m*. The signal processing unit 22 sets the correction coefficient β26 based on a gradation data difference (gr_n+2_m+2−gr_n_m) between the peripheral pixel 60*n*+2_m+2 and the target pixel 60*n_m*. The signal processing unit 22 sets the correction coefficient β27 based on a gradation data difference (gr_n+2_m−2−gr_n_m) between the peripheral pixel 60*n*+2_m−2 and the target pixel 60*n_m*. The signal processing unit 22 sets the correction coefficient β28 based on a gradation data difference (gr_n−2_m−2−gr_n_m) between the peripheral pixel 60*n*−2_m−2 and the target pixel 60*n_m*.

FIG. 9 illustrates the relation between the correction coefficients α and β and the gradation data differences between the peripheral pixels and the target pixel, as a first example. In the first example, the correction coefficients α and β have a relation of α=β. Thus, when the differences in gradation data between the peripheral pixels and the target pixel are 255, the correction coefficients α and β become 47 (α=β=47).

As illustrated in FIG. 3, when the gradation data gr of the pixels 60 of the (m−2)-th to m-th columns in the video data VD are 0 and the gradation data gr of the pixels 60 of the (m+1)-th and (m+2)-th columns are 255, the signal processing unit 22 sets the correction coefficients α21 to α28 and β21 to β28 to 47 (α21 to α28=β21 to (328=47), based on a lookup table in which the differences in gradation data between the peripheral pixels and the target pixel and the correction coefficients α21 to α28 and β21 to β28 are associated as illustrated in the graph of FIG. 9.

When the pixel 60*n_m* is set to the target pixel, the signal processing unit 22 calculates the gradation data of the peripheral pixels 60*n_m*+1 and 60*n_m*+2 disposed in the right direction with respect to the pixel 60*n_m*, based on an operation expression of $\alpha 22\times(gr_n_m+1-gr_n_m)+\beta 22\times(gr_n_m+2-gr_n_m)$ in Equation (2).

Figures 10, 11:
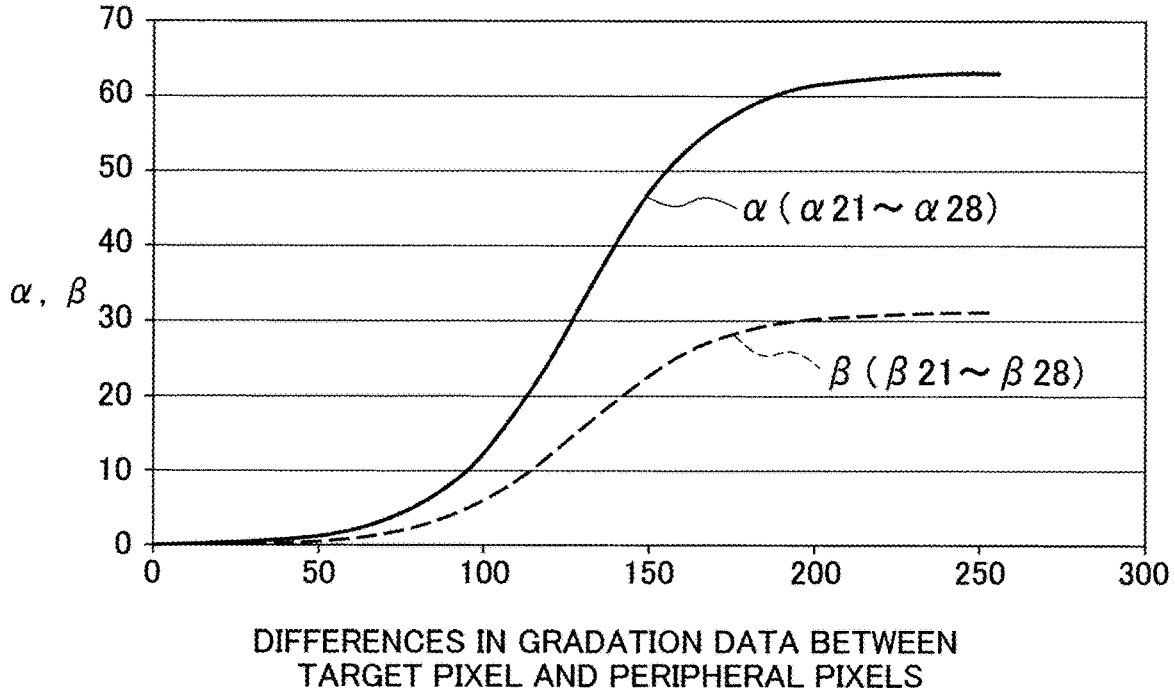
FIG. 10 illustrates an example in which the gradation data of the pixels are corrected.
FIG. 11 illustrates the relation between correction coefficients and differences in gradation data between peripheral pixels and a target pixel.

FIG. 10 shows the gradation data gr of the respective pixels 60, in association with FIG. 3. The signal processing unit 22 corrects the gradation data gr_n_m of the pixel 60*n_m* to 94. The signal processing unit 22 corrects the gradation data gr of the pixels 60 of the m-th column to 94 in the same manner as the pixel 60*n_m*. When the pixel 60*n_m*−1 is set to the target pixel, the signal processing unit 22 corrects the gradation data gr of the pixel 60*n_m*−1 to 47. The signal processing unit 22 corrects the gradation data gr of the pixels 60 of the (m−1)-th column to 47 in the same manner as the pixel 60*n_m*−1.

FIG. 11 illustrates the relation between the correction coefficients α and β and the differences in gradation data between the peripheral pixels and the target pixel, as a second example. In the second example, the correction coefficients α and β become 63 and 31 (α=63 and β=31), when the differences in gradation data between the peripheral pixels and the target pixel are 255. That is, in the relational expression of α=k×β, the coefficient k is set to about 2.

As illustrated in FIG. 3, when the gradation data gr of the pixels 60 of the (m−2)-th to m-th columns in the video data VD are 0 and the gradation data gr of the pixels 60 of the (m+1)-th and (m+2)-th columns are 255, the signal processing unit 22 sets the correction coefficients α21 to α28 to 63 and sets the correction coefficients and β21 to β28 to 31, based on a lookup table in which the differences in gradation data between the peripheral pixels and the target pixel and the correction coefficients α21 to α28 and β21 to β28 are associated as illustrated in the graph of FIG. 11.

When the pixel 60*n_m* is set to the target pixel, the signal processing unit 22 calculates the gradation data of the peripheral pixels 60*n_m*+1 and 60*n_m*+2 disposed in the right direction with respect to the pixel 60*n_m*, based on an operation expression of $\alpha 22\times(gr_n_m+1-gr_n_m)+\beta 22\times(gr_n_m+2-gr_n_m)$ in Equation (2).

Figures 12, 13:
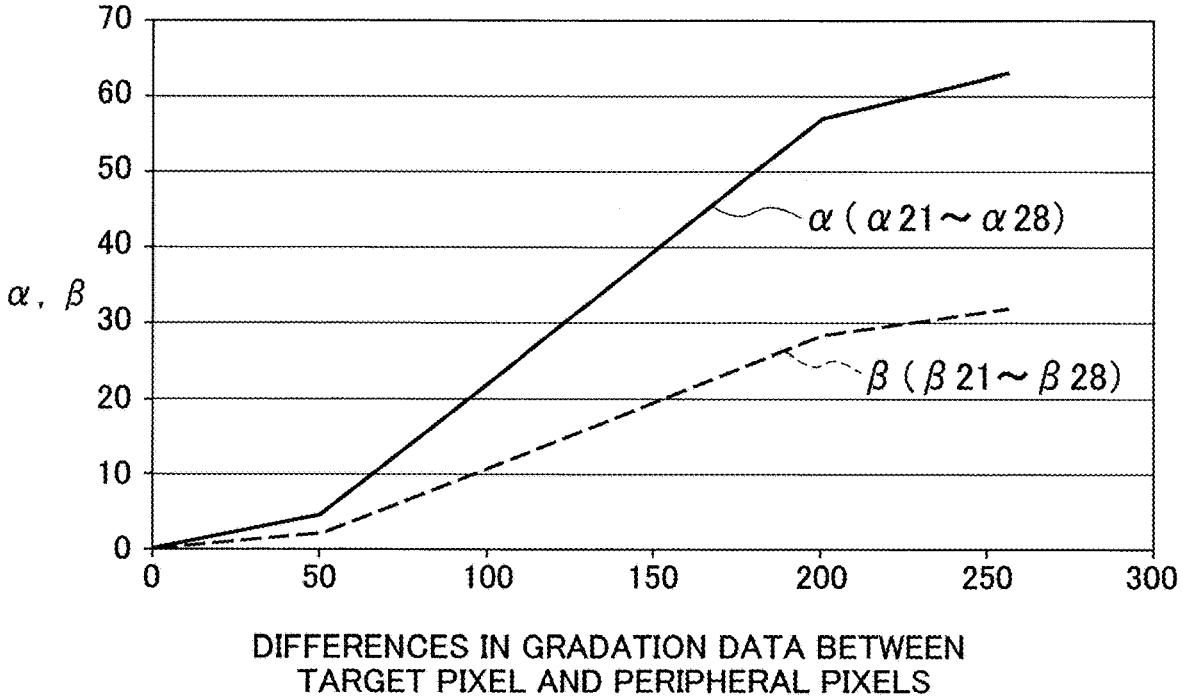
FIG. 12 illustrates an example in which the gradation data of the pixels are corrected.
FIG. 13 illustrates the relation between correction coefficients and differences in gradation data between peripheral pixels and a target pixel.

FIG. 12 shows the gradation data gr of the respective pixels 60, in association with FIG. 3. The signal processing unit 22 corrects the gradation data gr_n_m of the pixel 60*n_m* to 94. The signal processing unit 22 corrects the gradation data gr of the pixels 60 of the m-th column to 94 in the same manner as the pixel 60*n_m*. When the pixel 60*n_m*−1 is set to the target pixel, the signal processing unit 22 corrects the gradation data gr_n_m−1 of the pixel 60*n_m*−1 to 31. The signal processing unit 22 corrects the gradation data gr of the pixels 60 of the (m−1)-th column to 31 in the same manner as the pixel 60*n_m*−1.

FIG. 13 illustrates the relation between the correction coefficients α and β and the differences in gradation data between the peripheral pixels and the target pixel, as a third example. In the third example, the correction coefficients α and β become 63 and 31 (α=63 and β=31) when the differences in gradation data between the peripheral pixels and the target pixel are 255. That is, in the relational expression α=k×β, the coefficient k is set to about 2.

As illustrated in FIG. 3, when the gradation data gr of the pixels 60 of the (m−2)-th to m-th columns in the video data VD are 0 and the gradation data gr of the pixels 60 of the (m+1)-th and (m+2)-th columns are 255, the signal processing unit 22 sets the correction coefficients α21 to α28 to 63 and sets the correction coefficients β21 to β28 to 31, based on a lookup table in which the differences in gradation data between the peripheral pixels and the target pixel and the correction coefficients α21 to α28 and β21 to β28 are associated as illustrated in the graph of FIG. 13.

When the pixel 60*n_m* is set to the target pixel, the signal processing unit 22 calculates the gradation data of the peripheral pixels 60*n_m*+1 and 60*n_m*+2 disposed in the right direction with respect to the pixel 60*n_m*, based on an operation expression of $\{\alpha 22\times(gr_n_m+1-gr_n_m)+\beta 22\times(gr_n_m+2-gr_n_m)\}$ in Equation (2).

FIG. 14 shows the gradation data gr of the respective pixels 60, in association with FIG. 3. The signal processing unit 22 corrects the gradation data gr_n_m of the pixel 60*n_m* to 94. The signal processing unit 22 corrects the gradation data gr of the pixels 60 of the m-th column to 94 in the same manner as the pixel 60*n_m*. When the pixel 60*n_m*−1 is set to the target pixel, the signal processing unit 22 corrects the gradation data gr_n_m−1 of the pixel 60*n_m*−1 to 31. The signal processing unit 22 corrects the gradation data gr of the pixels 60 of the (m−1)-th column to 31 in the same manner as the pixel 60*n_m*−1.

The lookup table is not limited to the first to third examples, but may be appropriately determined according to the configuration, resolution, or pixel pitch of the display pixel unit 30 in order to prevent a reduction in contrast and an occurrence of disclination.

Therefore, the display device 12 and the display method according to a second embodiment can perform gradation correction based on the difference between the gradation data of the target pixel and the gradation data of two peripheral pixels disposed in each of the horizontal direction, the vertical direction, and the oblique direction with respect to the target pixel, such that the difference in gradation data between the target pixel and the peripheral pixels can be reduced with respect to two peripheral pixels, which makes it possible to prevent an occurrence of disclination.

Furthermore, since the display device 12 and the display method according to a second embodiment can perform gradation correction based on the difference between the gradation data of the target pixel and the gradation data of two peripheral pixels disposed in each of the horizontal direction, the vertical direction, and the oblique direction with respect to the target pixel, the display device 12 and the display method can prevent an occurrence of disclination in various image patterns, compared to when gradation correction is performed based on a difference between the gradation data of the target pixel and the gradation data of two peripheral pixels disposed in each of the horizontal direction and the vertical direction.

The direction in which disclination easily occurs may differ depending on the design specification of the display device 12 or each of display devices 12. The display device 12 and the display method according to a second embodiment perform gradation correction based on the difference between the gradation data of the target pixel and the gradation data of two peripheral pixels disposed in each of the horizontal direction, the vertical direction, and the oblique direction with respect to the target pixel. Therefore, the display device 12 and the display method can prevent an occurrence of disclination in various image patterns, even when the direction in which disclination easily occurs is different depending on the design specification of the display device 12 and each of display devices 12.

Moreover, when the direction in which disclination easily occurs is confirmed in advance, the display device 12 and the display method may perform gradation correction based on a difference between the gradation data of the target pixel and the gradation data of only two peripheral pixels disposed in the direction in which disclination is likely to occur, with respect to the target pixel.

Third Embodiment

As illustrated in FIG. 1, a display device 13 according to a third embodiment includes a signal processing unit 23 instead of the signal processing unit 21, and a display method through the signal processing unit 23 or specifically a gradation correction method for video data VD is different from that of the signal processing unit 21. Therefore, the gradation correction method for video data VD through the signal processing unit 23 will be described. For convenience of the description, the same components as those of the display device 11 according to a first embodiment are represented by the same reference numerals.

The signal processing unit 23 performs a gradation correction process on gradation data inputted to the respective pixels 60. Specifically, the signal processing unit 23 calculates a difference between gradation data of the target pixel and the gradation data of a peripheral pixel disposed in each of the horizontal direction, the vertical direction, and the oblique direction with respect to the target pixel, based on Equation (3). Then, the signal processing unit 23 specifies the maximum value from the calculation results, and sets the maximum value to a correction value CV for the target pixel.

$$CV_n_m = MAX\begin{pmatrix} \alpha 11 \times (gr_n-1_m-gr_n_m), \\ \alpha 12 \times (gr_n_m+1-gr_n_m), \\ \alpha 13 \times (gr_n+1_m-gr_n_m), \\ \alpha 14 \times (gr_n_m-1-gr_n_m), \\ \alpha 15 \times (gr_n-1_m+1-gr_n_m), \\ \alpha 16 \times (gr_n+1_m+1-gr_n_m), \\ \alpha 17 \times (gr_n+1_m-1-gr_n_m), \\ \alpha 18 \times (gr_n-1_m-1-gr_n_m) \end{pmatrix} \quad (3)$$

At this time, all to α18 of Equation (3) correspond to α11 to α18 of Equation (1). That is, Equation (3) corresponds to when β11 to β18 in Equation (1) are set to 0. For example, when the pixel 60*n_m* of the m-th column at the n-th row is set to the target pixel, the signal processing unit 23 calculates differences between the gradation data of the target pixel and the gradation data of peripheral pixels disposed in the horizontal direction, the vertical direction, and the oblique direction with respect to the pixel 60*n_m* set to the target pixel, based on Equation (3). The signal processing unit 23 specifies the maximum value MAX from the calculation results, and sets the maximum value MAX to a correction value CV_n_m for the pixel 60*n_m*.

The signal processing unit 23 calculates the differences between the peripheral pixels disposed in the horizontal direction, the vertical direction, and the oblique direction with respect to the target pixel, respectively, specifies the maximum value from the calculation results, and sets the maximum value to the correction value CV.

The signal processing unit 23 calculates the differences based on the correction coefficients α11 to α18 depending on the directions in which the peripheral pixels are disposed with respect to the target pixel or the distances between the target pixel and the peripheral pixels, specifies the maximum value from the calculation results, and sets the maximum value to the correction value CV for the target pixel. In the following descriptions, the horizontal direction may be set to the right direction or the left direction, the vertical direction may be set to the top direction or the bottom direction, and the oblique direction may be set to the top right direction, the bottom right direction, the bottom left direction or the top left direction.

Specifically, the signal processing unit 23 calculates a difference between the gradation data of the target pixel and the gradation data of the peripheral pixel 60*n*−1_m disposed in the top direction with respect to the pixel 60*n_m* set to the target pixel, based on an operation expression of α11×(gr_n−1_m−gr_n_m) in Equation (3). The signal processing unit 23 calculates a difference between the gradation data of the target pixel and the gradation data of the peripheral pixel 60*n_m*+1 disposed in the right direction with respect to the pixel 60*n_m*, based on an operation expression of α12×(gr_n_m+1−gr_n_m) in Equation (3).

The signal processing unit 23 calculates a difference between the gradation data of the target pixel and the gradation data of the peripheral pixel 60*n*+1_m disposed in the bottom direction with respect to the pixel 60*n_m*, based on an operation expression of α13×(gr_n+1_m−gr_n_m) in Equation (3). The signal processing unit 23 calculates a difference between the gradation data of the target pixel and the gradation data of the peripheral pixel 60*n_m*−1 disposed in the left direction with respect to the pixel 60*n_m*, based on an operation expression α14×(gr_n_m−1−gr_n_m) in Equation (3).

The signal processing unit 23 calculates a difference between the gradation data of the target pixel and the gradation data of the peripheral pixel 60*n*−1_m+1 disposed in the top right direction with respect to the pixel 60*n_m*, based on an operation expression of α15×(gr_n−1_m+1−gr_n_m) in Equation (3). The signal processing unit 23 calculates a difference between the gradation data of the target pixel and the gradation data of the peripheral pixel 60*n*+1_m+1 disposed in the bottom right direction with respect to the pixel 60*n_m*, based on an operation expression of {α16×(gr_n+1_m+1−gr_n_m)} in Equation (3).

The signal processing unit 23 calculates a difference between the gradation data of the target pixel and the gradation data of the peripheral pixel 60*n*+1_m−1 disposed in the bottom left direction with respect to the pixel 60*n_m*, based on an operation expression of α17×(gr_n+1_m−1−gr_n_m) in Equation (3). The signal processing unit 23 calculates a difference between the gradation data of the target pixel and the gradation data of the peripheral pixel 60*n*−1_m−1 disposed in the top left direction with respect to the pixel 60*n_m*, based on an operation expression of α18×(gr_n−1_m−1−gr_n_m) in Equation (3).

The signal processing unit 23 specifies the maximum value MAX from the calculation results, and sets the maximum value MAX to a correction value CV_n_m for the pixel 60*n_m*. The signal processing unit 23 corrects the gradation data of the pixel 60*n_m* into gradation data obtained by adding the correction value CV_n_m to the gradation data gr_n_m of the pixel 60*n_m* in the video data VD. That is, the signal processing unit 23 determines the correction value CV corresponding to the target pixel, based on the differences between the gradation data of the target pixel and the gradation data of the peripheral pixels disposed in the horizontal direction, the vertical direction, and the oblique direction with respect to the target pixel, respectively, among the plurality of pixels 60. The signal processing unit 23 increases the pixel value of the target pixel by adding the correction value CV to the gradation data of the target pixel, thereby decreasing the differences. The pixel value is a gradation value, for example.

The signal processing unit 23 determines the correction value CV corresponding to the target pixel, based on the differences between the gradation data of the target pixel and the gradation data of the peripheral pixel disposed in the right direction with respect to the target pixel, the gradation data of the peripheral pixel disposed in the left direction with respect to the target pixel, the gradation data of the peripheral pixel disposed in the top direction with respect to the target pixel, the gradation data of the peripheral pixel disposed in the bottom direction with respect to the target pixel, the gradation data of the peripheral pixel disposed in the top right direction with respect to the target pixel, the gradation data of the peripheral pixel disposed in the bottom right direction with respect to the target pixel, the gradation data of the peripheral pixel disposed in the bottom left direction with respect to the target pixel, and the gradation data of the peripheral pixel disposed in the top left direction with respect to the target pixel, respectively. The signal processing unit 23 increases the pixel value of the target pixel by adding the correction value CV to the gradation data of the target pixel, thereby decreasing the differences.

The signal processing unit 23 performs the same gradation correction process as the pixel 60*n_m* on the whole pixels 60 of the display pixel unit 30. The signal processing unit 23 generates gradation corrected video data SVD by performing a gradation correction process on the whole pixels 60 in the video data VD, and outputs the gradation corrected video data SVD to the horizontal scanning circuit 40.

When gradation correction is performed based on differences in gradation data between the target pixel and peripheral pixels disposed in the horizontal direction and the vertical direction with respect to the target pixel, that is when gradation correction is not performed based on differences in gradation data between the target pixel and peripheral pixels disposed in the oblique direction, the signal processing unit 23 corrects the gradation data of the pixels 60*n*−2_m+2, 60*n*−1_m+1, 60*n* m, 60*n*+1_m−1, and 60*n*+2_m−2 to 31, as illustrated in FIG. 15.

On the other hand, when gradation correction is performed based on the differences in gradation data between the target pixel and the peripheral pixels disposed in the horizontal direction, the vertical direction and the oblique direction with respect to the target pixel, the differences between the gradation data of the target pixel and the gradation data of the peripheral pixels disposed in the oblique direction with respect to the target pixel becomes the maximum value in the image pattern of FIG. 7.

Therefore, as illustrated in FIG. 16, the signal processing unit 23 corrects the gradation data gr of the pixels 60*n*−2_m+2, 60*n*−1_m+1, 60*n_m*, 60*n*+1_m−1, 60*n*+2_m−2, 60*n*−2_m+1, 60*n*−1_m, 60*n_m*−1, and 60*n*+1_m−2 to 31.

Accordingly, the display device 13 and the display method according to a third embodiment can perform gradation correction based on the differences between the gradation data of the target pixel and the gradation data of the peripheral pixels disposed in the horizontal direction, the vertical direction, and the oblique direction with respect to the target pixel, and thus reduce the differences in the gradation data between the target pixel and the peripheral pixels, which makes it possible to prevent an occurrence of disclination.

Furthermore, since the display device 13 and the display method according to a third embodiment can perform gradation correction based on the differences between the gradation data of the target pixel and the gradation data of the peripheral pixels disposed in the horizontal direction, the vertical direction, and the oblique direction with respect to the target pixel, the display device 13, and the display method can prevent an occurrence of disclination in various image patterns, compared to when gradation correction is performed based on the differences between the gradation data of the target pixel and the gradation data of the peripheral pixels disposed in the horizontal direction and the vertical direction.

Figure 17A:
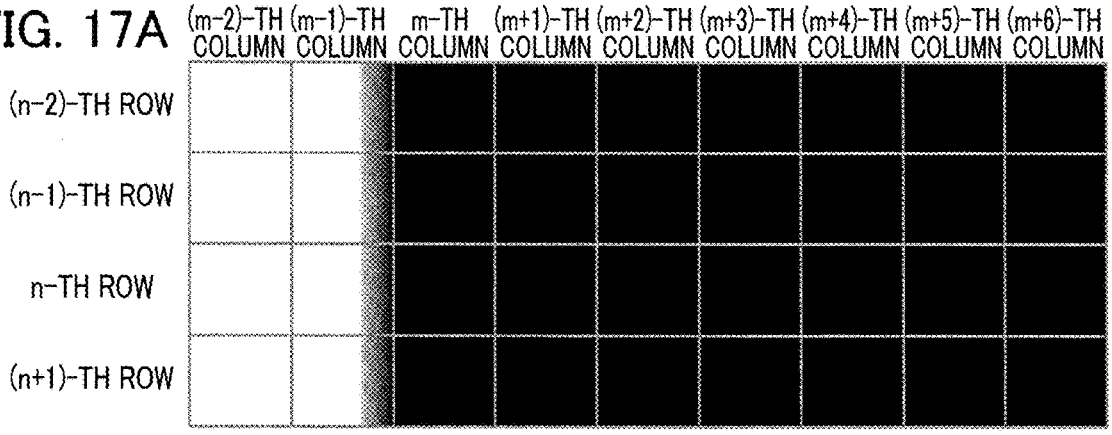
FIGS. 17A to 17D schematically illustrate examples of images which are successively displayed for each frame when gradation correction is not performed.
Figure 17B:
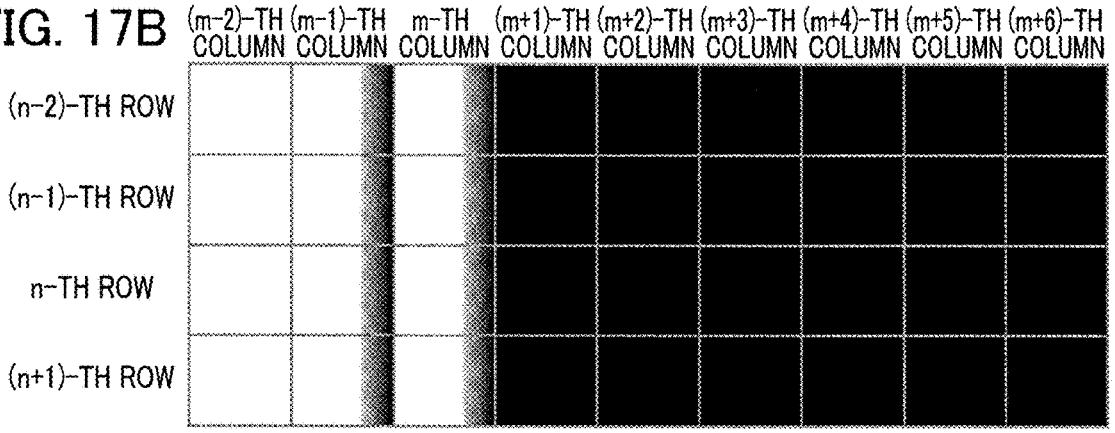
Figure 17C:
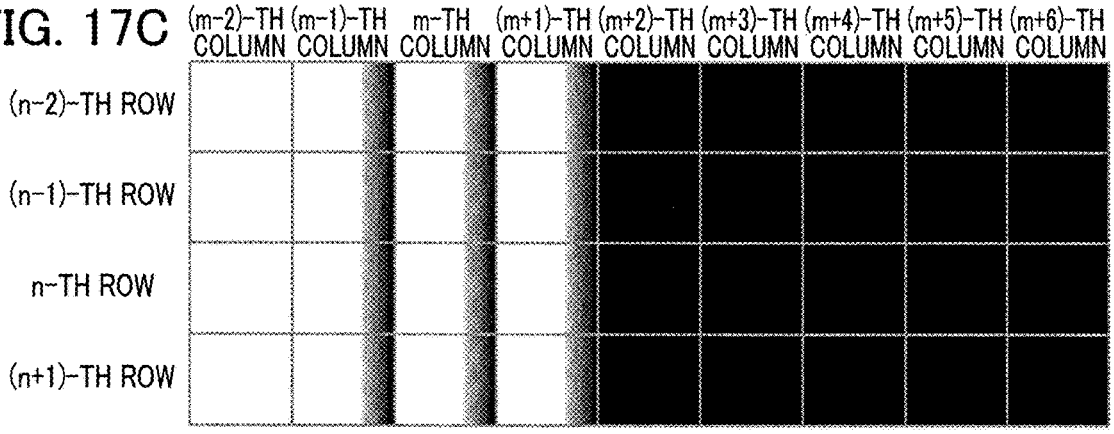
Figure 17D:
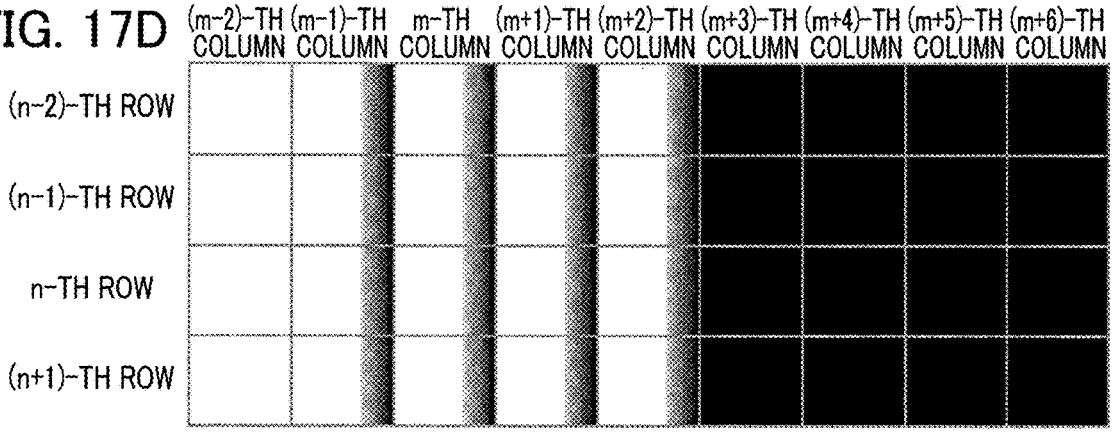
Figure 18A:
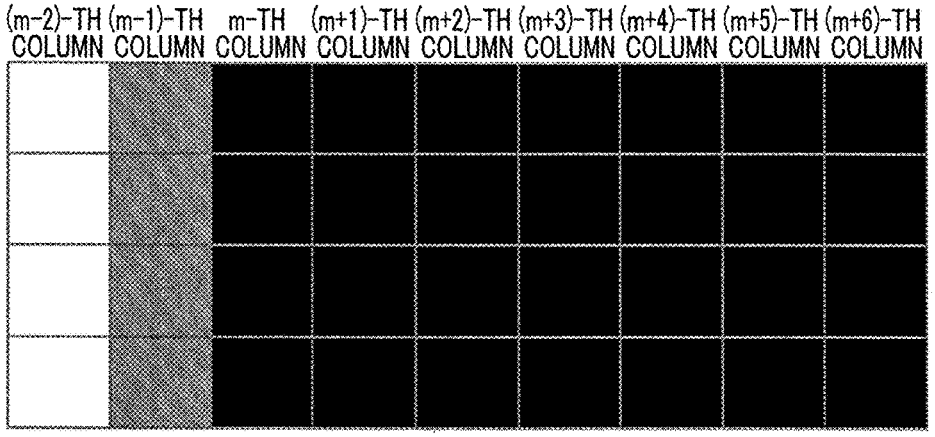
FIGS. 18A to 18D schematically illustrate examples of images which are successively displayed for each frame when gradation correction is performed based on peripheral pixels disposed in the horizontal direction and the vertical direction with respect to a target pixel.
Figure 18B:
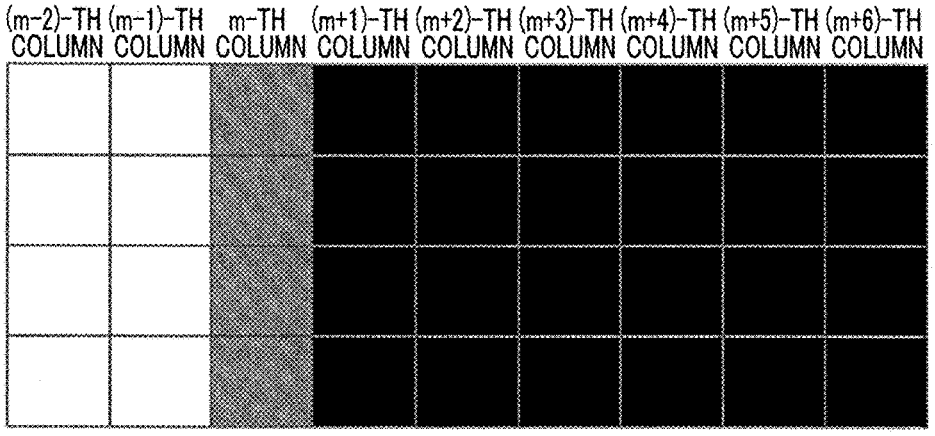
Figure 18C:
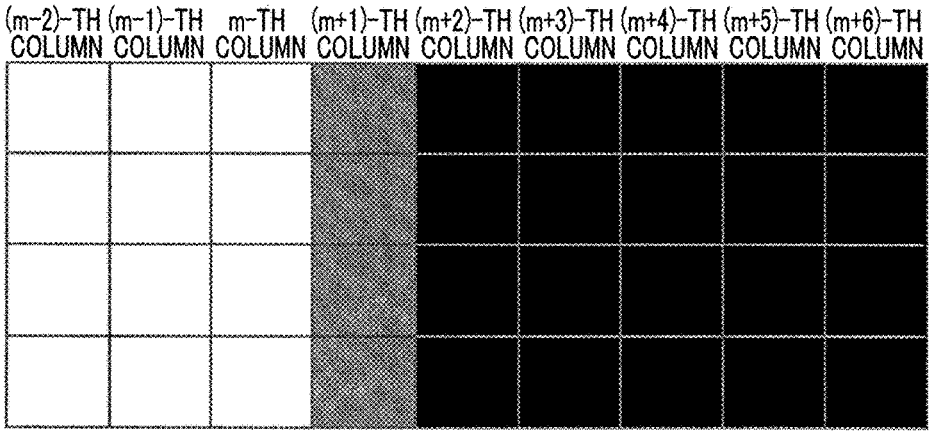
Figure 18D:
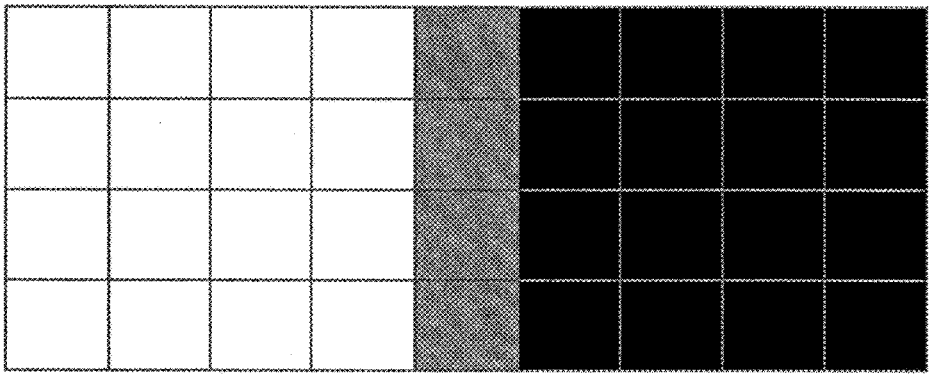
Figure 19A:
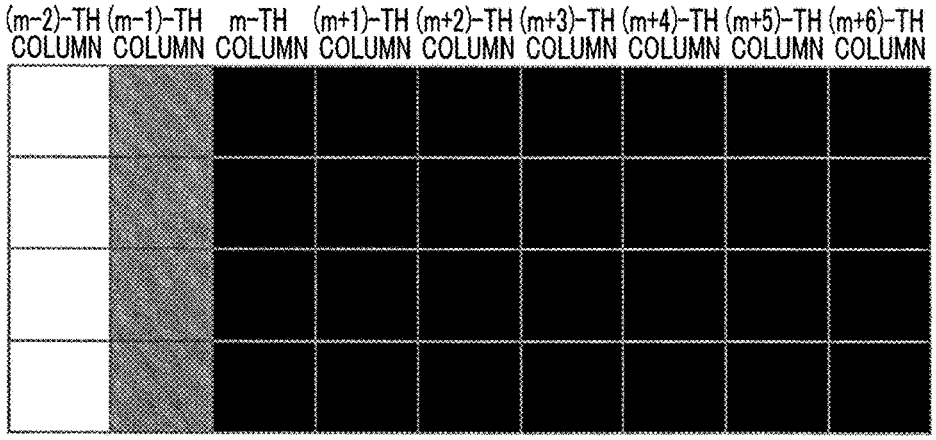
FIGS. 19A to 19D schematically illustrate examples of images which are successively displayed for each frame when gradation correction is performed based on peripheral pixels disposed in the horizontal direction, the vertical direction, and the oblique direction with respect to the target pixel.
Figure 19B:
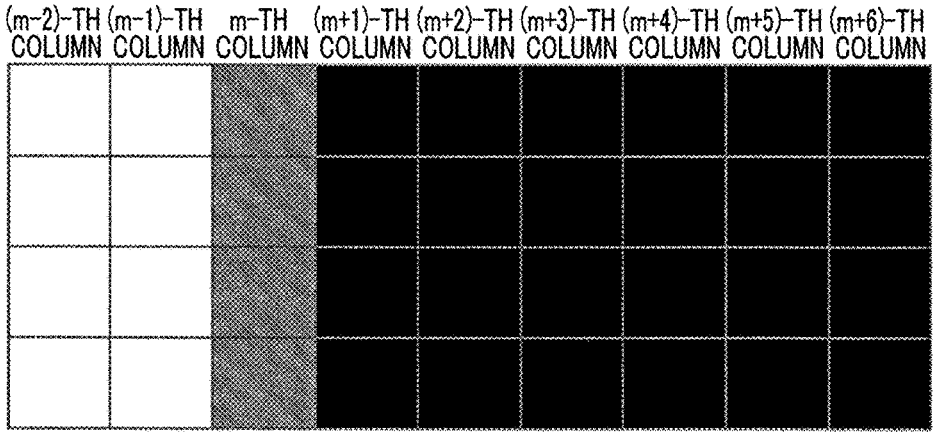
Figure 19C:
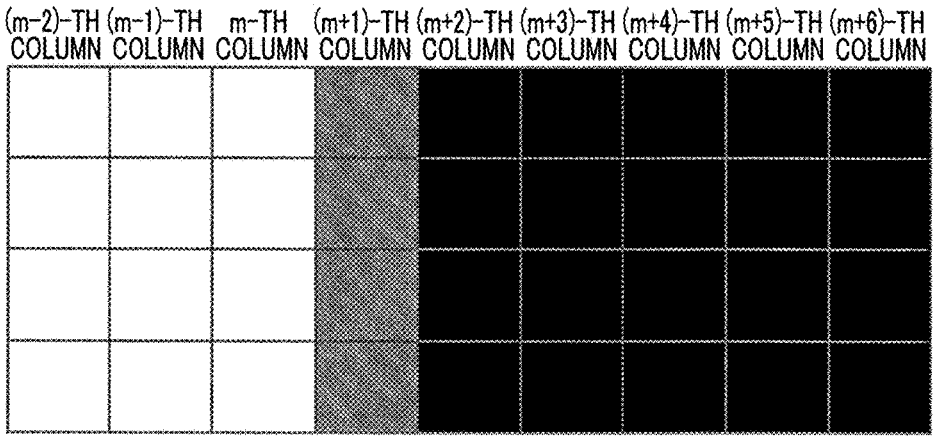
Figure 19D:
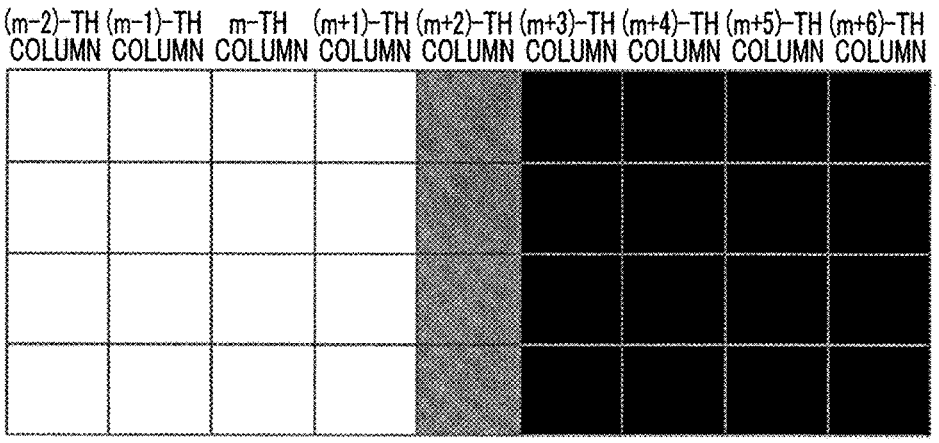

FIGS. 17A to 17D illustrate the pixels 60 of the (n−2)-th to (n+1)-th rows and the (m−2)-th to (m+6)-th columns of the display pixel unit 30 of FIG. 1. FIGS. 17A to 17D schematically illustrate an example of images which are successively displayed for each frame when gradation correction is not performed. FIG. 17A illustrates a display image of a first frame, FIG. 17B illustrates a display image of a second frame, FIG. 17C illustrates a display image of a third frame, and FIG. 17D illustrates a display image of a fourth frame.

FIG. 17A illustrates that the pixels 60 of the (m−2)-th and (m−1)-th columns in the video data VD are displayed in white (for example, gr=0), and the pixels 60 of the m-th to (m+6)-th columns are displayed in black (for example, gr=255). In the image pattern illustrated in FIG. 17A, the pixels 60 in the boundary portion between the (m−1)-th and m-th columns have a large potential difference. Therefore, when gradation correction is not performed, disclination may occur around the boundary portion of the pixels 60 of the (m−1)-th column.

FIG. 17B illustrates that the boundary portion between white display and black display is shifted to the right by one column from the state of FIG. 17A. FIG. 17C illustrates that the boundary portion between white display and black display is further shifted to the right by one column from the state of FIG. 17B. FIG. 17D illustrates that the boundary portion between white display and black display is further shifted to the right by one column from the state of FIG. 17C.

As illustrated in FIGS. 17A to 17D, if gradation correction is not performed, disclination occurs around the boundary portion between white display and black display whenever the boundary portion between white display and black display is shifted to the right by one column. Since the disclination does not immediately disappear, tailing occurs to degrade the quality of the display image.

FIGS. 18A to 18D schematically illustrate an example of images which are successively displayed for each frame when gradation correction is performed based on the peripheral pixels disposed in the horizontal direction and the vertical direction with respect to the target pixel. FIGS. 18A to 18D correspond to FIGS. 17A to 17D.

As illustrated in FIGS. 18A to 18D, the gradation correction is performed based on the peripheral pixels disposed in the horizontal direction and the vertical direction with respect to the target pixel, in order to reduce differences in gradation data between the target pixel and the peripheral pixels. Therefore, in the image patterns illustrated in FIGS. 18A to 18D, an occurrence of disclination can be prevented.

FIGS. 19A to 19D schematically illustrate an example of images that are successively displayed for each frame when gradation correction is performed based on the peripheral pixels disposed in the horizontal direction, the vertical direction and the oblique direction with respect to the target pixel. FIGS. 19A to 19D correspond to FIGS. 17A to 17D and FIGS. 18A to 18D.

As illustrated in FIGS. 19A to 19D, the gradation correction is performed based on the peripheral pixels disposed in the horizontal direction, the vertical direction, and the oblique direction with respect to the target pixel, in order to reduce differences in gradation data between the target pixel and the peripheral pixels. Therefore, in the image patterns illustrated in FIGS. 19A to 19D, an occurrence of disclination can be prevented.

Figure 20A:
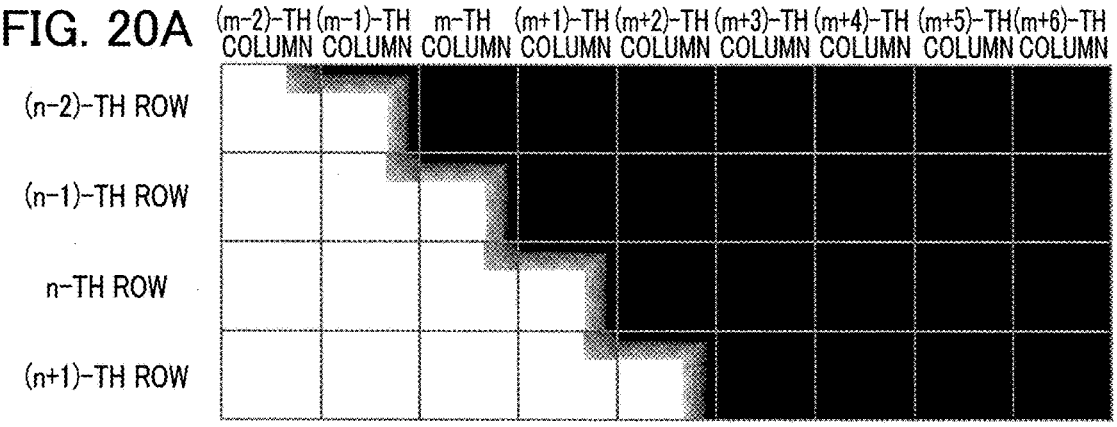
FIGS. 20A to 20D schematically illustrate examples of images which are successively displayed for each frame when gradation correction is not performed.
Figure 20B:
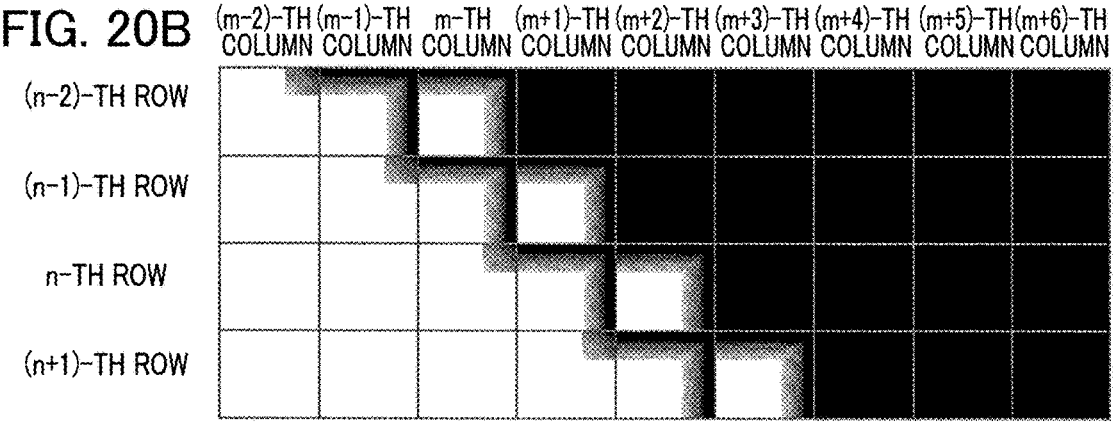
Figure 20C:
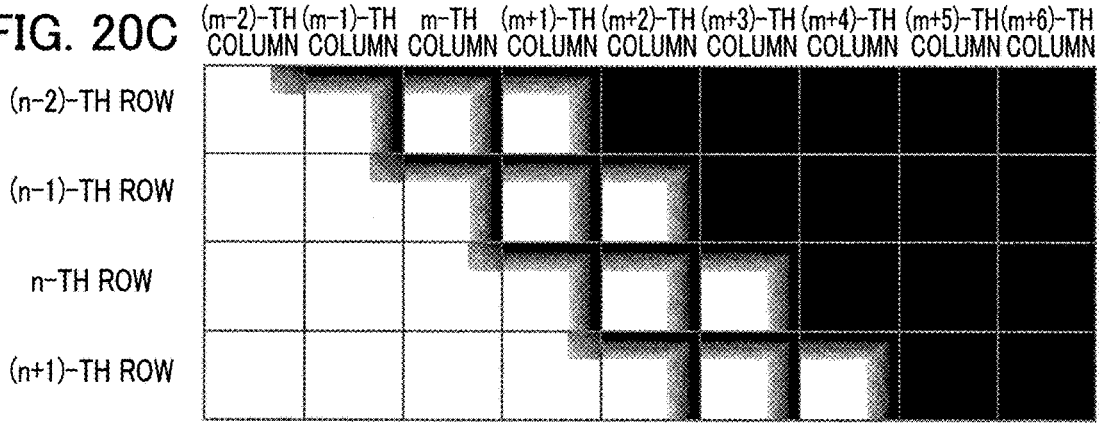
Figure 20D:
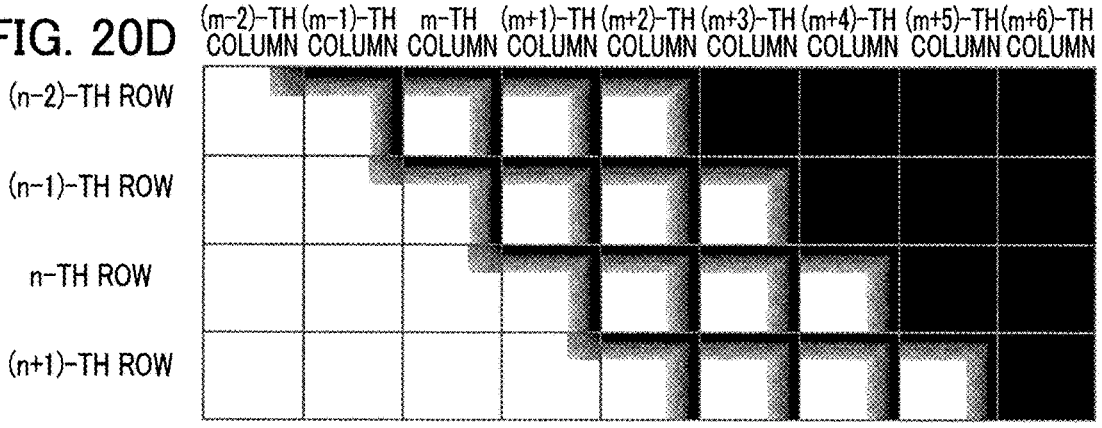
Figure 21A:
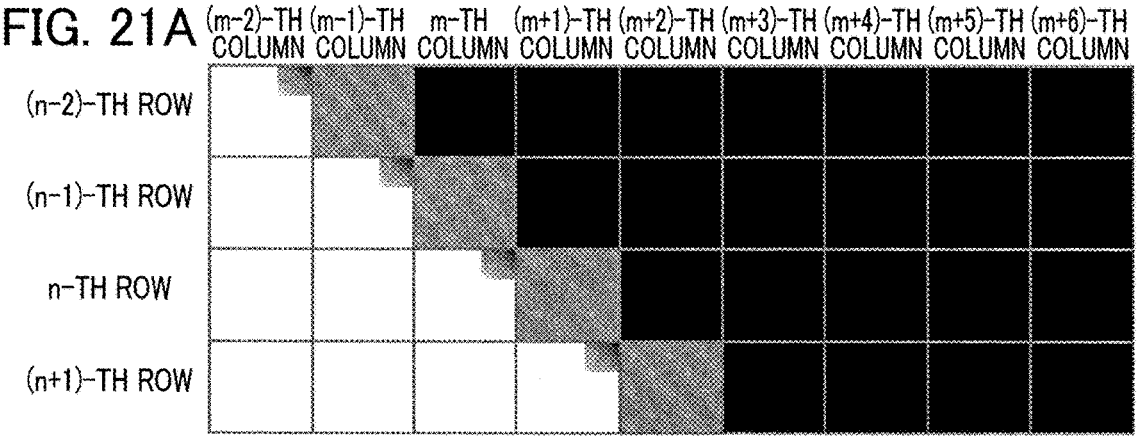
FIGS. 21A to 21D schematically illustrate examples of images which are successively displayed for each frame when gradation correction is performed based on peripheral pixels disposed in the horizontal direction and the vertical direction with respect to the target pixel.
Figure 21B:
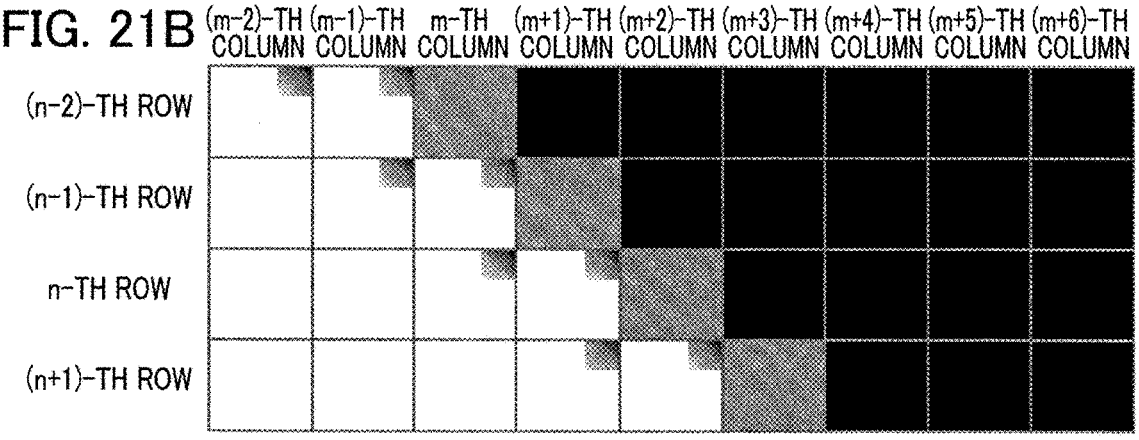
Figure 21C:
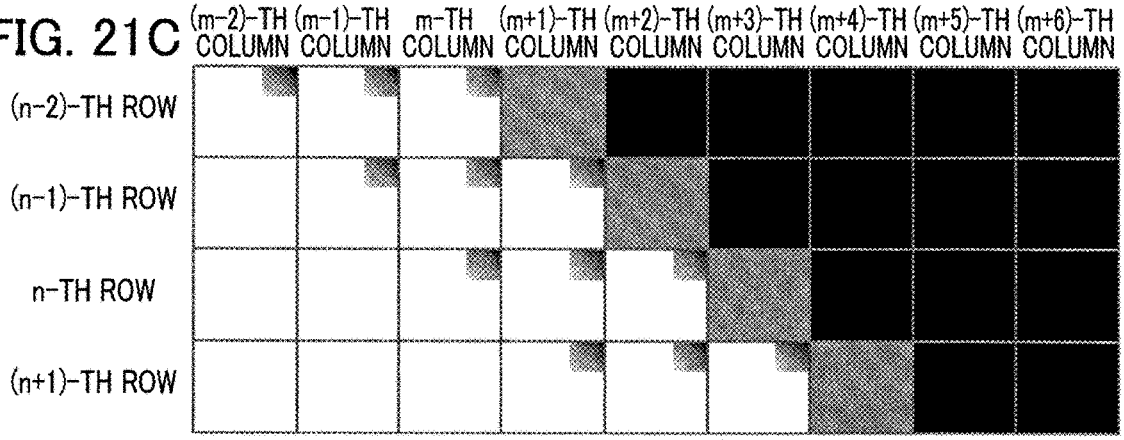
Figure 21D:
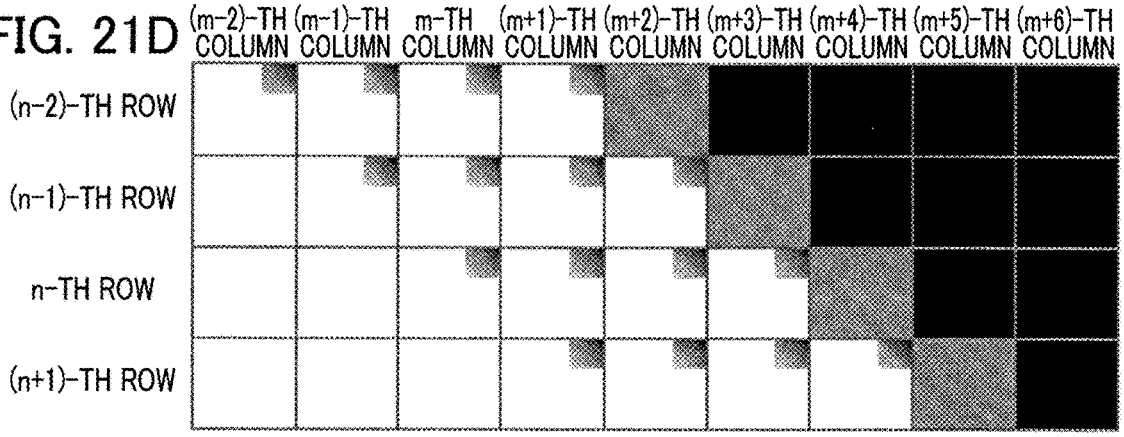
Figure 22A:
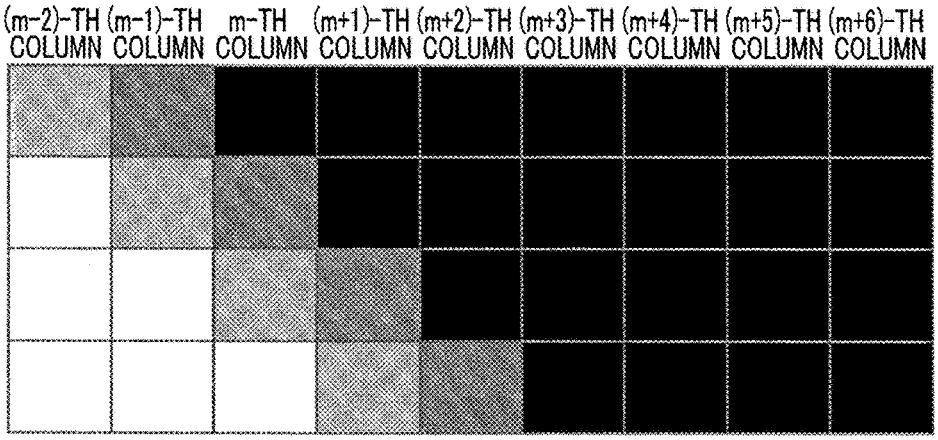
FIGS. 22A to 22D schematically illustrate examples of images which are successively displayed for each frame when gradation correction is performed based on peripheral pixels disposed in the horizontal direction, the vertical direction, and the oblique direction with respect to the target pixel.
Figure 22B:
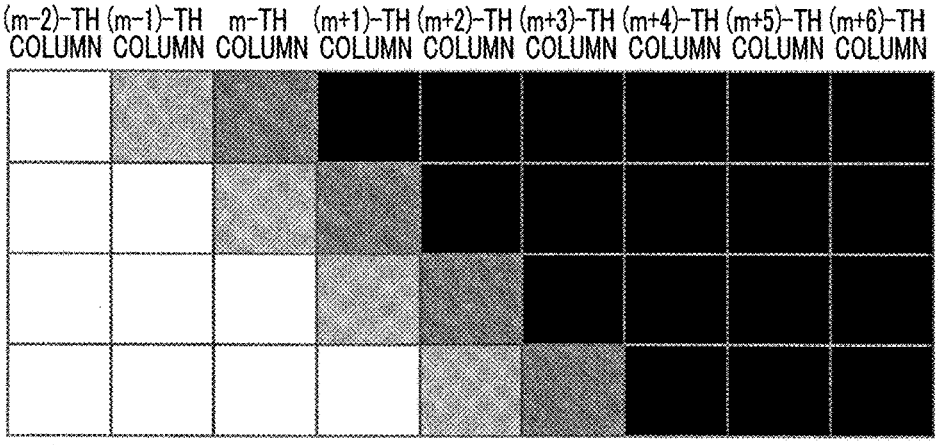
Figure 22C:
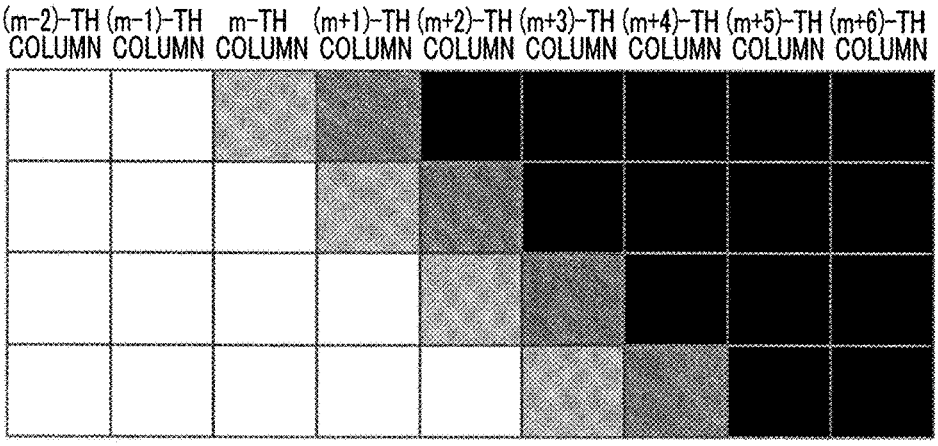
Figure 22D:
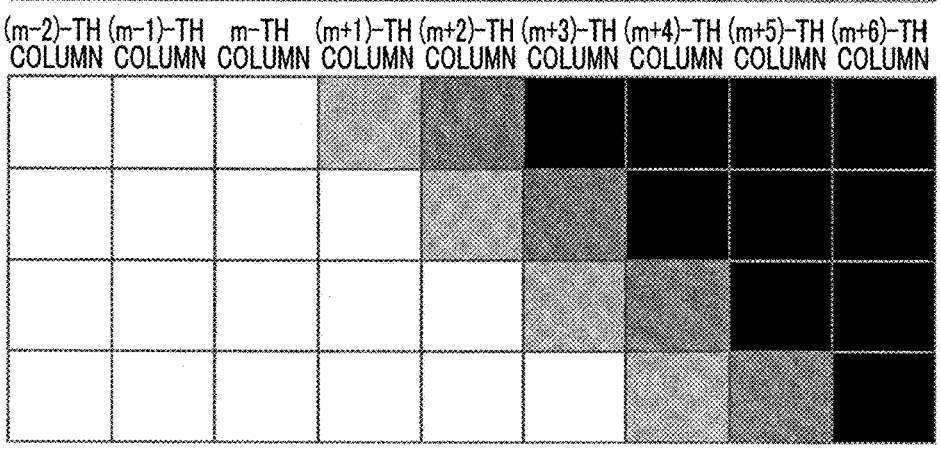

FIGS. 20A to 20D illustrate the pixels 60 of the (n−2)-th to (n+1)-th rows and the (m−2)-th to (m+6)-th columns of the display pixel unit 30 of FIG. 1. FIGS. 20A to 20D schematically illustrate an example of images which are successively displayed for each frame when gradation correction is not performed. FIG. 20A illustrates a display image of a first frame, FIG. 20B illustrates a display image of a second frame, FIG. 20C illustrates a display image of a third frame, and FIG. 20D illustrates a display image of a fourth frame. FIGS. 20A to 20D illustrate image patterns different from those of FIGS. 17A to 17D.

FIG. 20A illustrates that the pixels 60 of the (n−2)-th to (n+1)-th rows at the (m−2)-th to (m−1)-th columns, the pixels 60 of the (n−1)-th to (n+1)-th rows at the m-th column, the pixels 60 of the n-th and (n+1)-th rows at the (m+1)-th column, and the pixels 60 of the (n+1)-th row at the (m+2)-th column in the video data VD are displayed in white, and the other pixels 60 are displayed in black. In the image pattern illustrated in FIG. 20A, the pixels 60 in the boundary portion between the pixels 60 displayed in white and the pixels 60 displayed in black have a large potential difference therebetween. Therefore, when gradation correction is not performed, disclination may occur around the boundary portion.

FIG. 20B illustrates that the boundary portion between white display and black display is shifted to the right by one column from the state of FIG. 20A. FIG. 20C illustrates that the boundary portion between white display and black display is further shifted to the right by one column from the state of FIG. 20B. FIG. 20D illustrates that the boundary portion between white display and black display is further shifted to the right by one column from the state of FIG. 20C.

As illustrated in FIGS. 20A to 20D, if gradation correction is not performed, disclination occurs around the boundary portion between white display and black display whenever the boundary portion between white display and black display is shifted to the right by one column. Since the disclination does not immediately disappear, tailing occurs to degrade the quality of the display image.

FIGS. 21A to 21D schematically illustrate an example of images which are successively displayed for each frame when gradation correction is performed based on the peripheral pixels disposed in the horizontal direction and the vertical direction with respect to the target pixel. FIGS. 21A to 21D correspond to FIGS. 20A to 20D.

As illustrated in FIGS. 21A to 21D, when gradation correction is performed based on the peripheral pixels disposed in the horizontal direction and the vertical direction with respect to the target pixel, an occurrence of disclination can be reduced, compared to when gradation correction is not performed. However, an occurrence of disclination cannot be sufficiently prevented, due to the influence of the peripheral pixels disposed in the oblique direction with respect to the target pixel.

FIGS. 22A to 22D schematically illustrate an example of images that are successively displayed for each frame when gradation correction is performed based on peripheral pixels disposed in the horizontal direction, the vertical direction, and the oblique direction with respect to the target pixel. FIGS. 22A to 22D correspond to FIGS. 20A to 20D and FIGS. 21A to 21D.

As illustrated in FIGS. 22A to 22D, the gradation correction can be performed based on the peripheral pixels disposed in the horizontal direction, the vertical direction, and the oblique direction with respect to the target pixel, in order to reduce the differences in gradation data between the target pixel and the peripheral pixels disposed in the oblique direction with respect to the target pixel. Therefore, in the image patterns illustrated in FIGS. 22A to 22D, an occurrence of disclination can be prevented.

The direction in which disclination easily occurs may differ depending on the design specification of the display device 13 or each of display devices 13. The display device 13 and the display method according to a third embodiment perform gradation correction based on the peripheral pixels disposed in the horizontal direction, the vertical direction, and the oblique direction with respect to the target pixel. Therefore, the display device 13 and the display method can prevent an occurrence of disclination in various image patterns, even when the direction in which disclination easily occurs is different depending on the design specification of the display device 13 and each of display devices 13.

When the direction in which disclination easily occurs is confirmed in advance, the display device 13 and the display method may perform gradation correction based on only peripheral pixels adjacent to the target pixel in the direction that disclination easily occurs.

Fourth Embodiment

As illustrated in FIG. 1, a display device 14 according to a fourth embodiment includes a signal processing unit 24 instead of the signal processing unit 22, and a display method through the signal processing unit 24 or specifically a gradation correction method for video data VD is different from the display method through the signal processing unit 22. Therefore, the gradation correction method for video data VD through the signal processing unit 24 will be described. For convenience of the description, the same components as those of the display device 12 according to a second embodiment are represented by the same reference numerals.

The signal processing unit 24 performs a gradation correction process on gradation data inputted to the respective pixels 60. Specifically, the signal processing unit 24 calculates gradation data of peripheral pixels disposed in the horizontal direction, the vertical direction, and the oblique direction with respect to a target pixel, based on Equation (4). Then, the signal processing unit 24 specifies the maximum value from the calculation results, and sets the maximum value to a correction value CV for the target pixel.

$$CV_n_m = MAX\begin{pmatrix} \alpha 21 \times (gr_n-1_m - gr_n_m), \\ \alpha 22 \times (gr_n_m+1 - gr_n_m), \\ \alpha 23 \times (gr_n+1_m - gr_n_m), \\ \alpha 24 \times (gr_n_m-1 - gr_n_m), \\ \alpha 25 \times (gr_n-1_m+1 - gr_n_m), \\ \alpha 26 \times (gr_n+1_m+1 - gr_n_m), \\ \alpha 27 \times (gr_n+1_m-1 - gr_n_m), \\ \alpha 28 \times (gr_n-1_m-1 - gr_n_m) \end{pmatrix} \quad (4)$$

The correction coefficients α21 to α28 of Equation (4) correspond to the correction coefficients α21 to α28 of Equation (2). That is, Equation (4) corresponds to when the correction coefficients β21 to β28 are zero in Equation (2). For example, when the pixel 60*n_m* of the m-th column at the n-th row is set to the target pixel, the signal processing unit 24 calculates the gradation data of peripheral pixels disposed in the horizontal direction, the vertical direction, and the oblique direction with respect to the pixel 60*n_m* set to the target pixel, based on Equation (4). The signal processing unit 24 specifies the maximum value MAX from the calculation results, and sets the maximum value MAX to a correction value CV_n_m in the pixel 60*n* m.

The signal processing unit 24 calculates differences between the peripheral pixels disposed in the horizontal direction, the vertical direction, and the oblique direction with respect to the target pixel, specifies the maximum value from the calculation results, and sets the maximum value to the correction value CV.

The signal processing unit 24 calculates the differences based on the correction coefficients α21 to α28 depending on the directions in which the peripheral pixels are disposed with respect to the target pixel or the distances between the target pixel and the peripheral pixels, specifies the maximum value from the calculation results, and sets the maximum value to the correction value CV for the target pixel. In the following descriptions, the horizontal direction may be set to the right direction or the left direction, the vertical direction may be set to the top direction or the bottom direction, and the oblique direction may be set to the top right direction, the bottom right direction, the bottom left direction, or the top left direction.

Specifically, the signal processing unit 24 calculates the gradation data of the peripheral pixel 60*n*−1_m disposed in the top direction with respect to the pixel 60*n_m* set to the target pixel, based on an operation expression of α21×(gr_n−1_m−gr_n_m) in Equation (4). The signal processing unit 24 calculates the gradation data of the peripheral pixel 60*n_m*+1 disposed in the right direction with respect to the pixel 60*n_m*, based on an operation expression of α22×(gr_n−1_m+1−gr_n_m) in Equation (4).

The signal processing unit 24 calculates the gradation data of the peripheral pixel 60*n*+1_m disposed in the bottom direction with respect to the pixel 60*n_m*, based on an operation expression of α23×(gr_n+1_m−gr_n_m) in Equation (4). The signal processing unit 24 calculates the gradation data of the peripheral pixel 60*n_m*−1 disposed in the left direction with respect to the pixel 60*n_m*, based on an operation expression of α24×(gr_n_m−1−gr_n_m) in Equation (4).

The signal processing unit 24 calculates the gradation data of the peripheral pixel 60*n*−1_m+1 disposed in the top right direction with respect to the pixel 60*n_m*, based on an operation expression of α25×(gr_n−1_m+1−gr_n_m) in Equation (4). The signal processing unit 24 calculates the gradation data of the peripheral pixel 60*n*+1_m+1 disposed in the bottom right direction with respect to the pixel 60*n_m*, based on an operation expression of α26×(gr_n+1_m+1−gr_n_m) in Equation (4).

The signal processing unit 24 calculates the gradation data of the peripheral pixel 60*n*+1_m−1 disposed in the bottom left direction with respect to the pixel 60*n_m*, based on an operation expression of α27×(gr_n+1_m−1−gr_n_m) in Equation (4). The signal processing unit 24 calculates the gradation data of the peripheral pixel 60*n*−1_m−1 disposed in the top left direction with respect to the pixel 60*n_m*, based on an operation expression of α28×(gr_n−1_m−1−gr_n_m) in Equation (4). The method for setting the correction coefficients α21 to α28 may be performed in the same manner as the method for setting the correction coefficients α21 to α28 according to a second embodiment.

The signal processing unit 24 specifies the maximum value MAX from the calculation results, and sets the maximum value MAX to a correction value CV_n_m for the pixel 60*n_m*. The signal processing unit 24 corrects the gradation data of the pixel 60*n_m* to gradation data obtained by adding the correction value CV_n_m to the gradation data gr_n_m of the pixel 60*n_m* in the video data VD. That is, the signal processing unit 24 determines the correction value CV corresponding to the target pixel, based on the gradation data of the peripheral pixels disposed in the horizontal direction, the vertical direction and the oblique direction with respect to the target pixel, respectively, among the plurality of pixels 60. The signal processing unit 24 increases the pixel value of the target pixel by adding the correction value CV to the gradation data of the target pixel, thereby decreasing the differences in gradation data between the target pixel and the peripheral pixels. The pixel value is a gradation value, for example.

The signal processing unit 24 determines the correction value CV corresponding to the target pixel, based on the gradation data of the peripheral pixel disposed in the right direction, the gradation data of the peripheral pixel disposed in the left direction, the gradation data of the peripheral pixel disposed in the top direction, the gradation data of the peripheral pixel disposed in the bottom direction, the gradation data of the peripheral pixel disposed in the top right direction, the gradation data of the peripheral pixel disposed in the bottom right direction, the gradation data of the peripheral pixel disposed in the bottom left direction, and the gradation data of the peripheral pixel disposed in the top left direction, with respect to the target pixel. The signal processing unit 24 increases the pixel value of the target pixel by adding the correction value CV to the gradation data of the target pixel, thereby decreasing the differences.

The signal processing unit 24 performs the same gradation correction process as the pixel 60*n_m* on the whole pixels 60 of the display pixel unit 30. The signal processing unit 24 generates gradation corrected video data SVD by performing a gradation correction process on the whole pixels 60 in the video data VD, and outputs the gradation corrected video data SVD to the horizontal scanning circuit 40.

Therefore, the display device 14 and the display method according to a fourth embodiment can perform gradation correction based on the peripheral pixels disposed in the horizontal direction, the vertical direction, and the oblique direction with respect to the target pixel, and thus reduce the differences in gradation data between the target pixel and the peripheral pixels. Thus, the display device 14 and the display method can prevent an occurrence of disclination.

Furthermore, since the display device 14 and the display method according to a fourth embodiment can perform gradation correction based on the peripheral pixels disposed in the horizontal direction, the vertical direction, and the oblique direction with respect to the target pixel, the display device 14 and the display method can prevent an occurrence of disclination in various image patterns, compared to when gradation correction is performed based on the peripheral pixels disposed in the horizontal direction and the vertical direction.

In the display device 14 and the display method according to a fourth embodiment, the same display images as the display images illustrated in FIGS. 17A to 17D, FIGS. 18A to 18D, FIGS. 19A to 19D, FIGS. 20A to 20D, FIGS. 21A to 21D, and FIGS. 22A to 22D are confirmed.

The direction in which disclination easily occurs may differ depending on the design specification of the display device 14 or each of display devices 14. The display device 14 and the display method according to a fourth embodiment perform gradation correction based on the peripheral pixels disposed in the horizontal direction, the vertical direction and the oblique direction with respect to the target pixel. Therefore, the display device 14 and the display method can prevent an occurrence of disclination in various image patterns, even when the direction in which disclination easily occurs is different depending on the design specification of the display device 14 and each of display devices 14.

When the direction in which disclination easily occurs is confirmed in advance, the display device 14 and the display method may perform gradation correction based on only peripheral pixels adjacent to the target pixel in the direction that disclination easily occurs.

60*n_m* is set to the target pixel, the signal processing units 21 and 22 may set one or more of the pixels 60*n*−2_m−1, 60*n*−2_m+1, 60*n*−1_m−2, 60*n*−1_m+2, 60*n*+1_m−2, 60*n*+1_m+2, 60*n*+2_m−1, and 60*n*+2_m+1, which were not set to the calculation targets in first and second embodiments, to peripheral pixels in order to determine the correction value CV.

The display devices 11 to 14 and the display methods according to first to fourth embodiments may calculate the differences between the gradation data of the target pixel and the gradation data of the peripheral pixels by subtracting the gradation data of the target pixel from the gradation data of the peripheral pixels as expressed in Equations (1) to (4). However, the display devices 11 to 14 and the display methods according to first to fourth embodiments may calculate the differences between the gradation data of the target pixel and the gradation data of the peripheral pixels by subtracting the gradation data of the peripheral pixels from the gradation data of the target pixel, specify the maximum value from the calculation results, and set the maximum value to the correction value CV for the target pixel.

Specifically, in the display device 11 and the display method according to a first embodiment, the signal processing unit 21 calculates a difference between the gradation data of the target pixel and the gradation data of two peripheral pixels disposed in each of the horizontal direction, the vertical direction, and the oblique direction with respect to the target pixel, based on Equation (5). Then, the signal processing unit 21 specifies the maximum value from the calculation results, and sets the maximum value to the correction value CV for the target pixel.

$$\mathrm{CV_n_m} = \mathrm{MAX}\begin{pmatrix} \alpha 11\times(\mathrm{gr_n_m}-\mathrm{gr_n-1_m})+\beta 11\times(\mathrm{gr_n_m}-\mathrm{gr_n-2_m}), \\ \alpha 12\times(\mathrm{gr_n_m}-\mathrm{gr_n_m+1})+\beta 12\times(\mathrm{gr_n_m}-\mathrm{gr_n_m+2}), \\ \alpha 13\times(\mathrm{gr_n_m}-\mathrm{gr_n+1_m})+\beta 13\times(\mathrm{gr_n_m}-\mathrm{gr_n+2_m}), \\ \alpha 14\times(\mathrm{gr_n_m}-\mathrm{gr_n_m-1})+\beta 14\times(\mathrm{gr_n_m}-\mathrm{gr_n_m-2}), \\ \alpha 15\times(\mathrm{gr_n_m}-\mathrm{gr_n-1_m+1})+\beta 15\times(\mathrm{gr_n_m}-\mathrm{gr_n-2_m+2}), \\ \alpha 16\times(\mathrm{gr_n_m}-\mathrm{gr_n+1_m+1})+\beta 16\times(\mathrm{gr_n_m}-\mathrm{gr_n+2_m+2}), \\ \alpha 17\times(\mathrm{gr_n_m}-\mathrm{gr_n+1_m-1})+\beta 17\times(\mathrm{gr_n_m}-\mathrm{gr_n+2_m-2}), \\ \alpha 18\times(\mathrm{gr_n_m}-\mathrm{gr_n-1_m-1})+\beta 18\times(\mathrm{gr_n_m}-\mathrm{gr_n-2_m-2}) \end{pmatrix} \tag{5}$$

The present invention is not limited to the above-described one or more embodiments, but can be modified in various manners without departing the scope of the present invention.

In the display devices 11 and 12 and the display methods according to first and second embodiments, the signal processing units 21 and 22 calculate the gradation data of two peripheral pixels disposed in each of the horizontal direction, the vertical direction and the oblique direction with respect to the target pixel, specify the maximum value MAX from the calculation results, and set the maximum value MAX to the correction value CV for the target pixel. In the display devices 11 and 12 and the display methods according to first and second embodiments, the signal processing units 21 and 22 may calculate gradation data of three or more peripheral pixels, specify the maximum value MAX from the calculation results, and set the maximum value MAX to the correction value CV for the target pixel.

The signal processing units 21 and 22 may determine the correction value CV from the top three large values among the calculation results, values equal to or more than a predetermined value among the calculation results, or the sum or average of the calculation results. When the pixel For example, when the pixel 60*n_m* of the m-th column at the n-th row is set to the target pixel, the signal processing unit 21 calculates the difference between the gradation data of the target pixel and the gradation data of two peripheral pixels disposed in each of the horizontal direction, the vertical direction, and the oblique direction with respect to the pixel 60*n_m* set to the target pixel, based on Equation (5). The signal processing unit 21 specifies the maximum value MAX from the calculation results, and sets the maximum value MAX to a correction value CV_n_m for the pixel 60*n* m.

The signal processing unit 21 determines the correction value CV corresponding to the target pixel, based on a difference between the gradation data of the target pixel and the gradation data of a first peripheral pixel adjacent to the target pixel and a second peripheral pixel adjacent to the first peripheral pixel, among the plurality of pixels 60. The signal processing unit 21 decreases the pixel value of the target pixel by subtracting the correction value CV from the gradation data of the target pixel, thereby decreasing the difference. The pixel value is a gradation value, for example.

That is, the signal processing unit 21 determines the correction value CV corresponding to the target pixel based on the difference between the gradation data of the target pixel and the gradation data of the two peripheral pixels disposed in each of the horizontal direction, the vertical direction, and the oblique direction with respect to the target pixel, among the plurality of pixels 60. Then, the signal processing unit 21 reduces the pixel value of the target pixel by subtracting the correction value CV from the gradation data of the target pixel, thereby decreasing the difference.

In the display device 12 and the display method according to a second embodiment, the signal processing unit 22 calculates the difference between the gradation data of the target pixel and the gradation data of two peripheral pixels disposed in each of the horizontal direction, the vertical direction, and the oblique direction with respect to the target pixel, based on Equation (6). Then, the signal processing unit 22 specifies the maximum value from the calculation results, and sets the maximum value to the correction value CV for the target pixel.

$$\mathrm{CV_n_m} = \mathrm{MAX}\begin{pmatrix} \alpha 21 \times (\mathrm{gr_n_m} - \mathrm{gr_n-1_m}) + \beta 21 \times (\mathrm{gr_n_m} - \mathrm{gr_n-2_m}), \\ \alpha 22 \times (\mathrm{gr_n_m} - \mathrm{gr_n_m+1}) + \beta 22 \times (\mathrm{gr_n_m} - \mathrm{gr_n_m+2}), \\ \alpha 23 \times (\mathrm{gr_n_m} - \mathrm{gr_n+1_m}) + \beta 23 \times (\mathrm{gr_n_m} - \mathrm{gr_n+2_m}), \\ \alpha 24 \times (\mathrm{gr_n_m} - \mathrm{gr_n_m-1}) + \beta 24 \times (\mathrm{gr_n_m} - \mathrm{gr_n_m-2}), \\ \alpha 25 \times (\mathrm{gr_n_m} - \mathrm{gr_n-1_m+1}) + \beta 25 \times (\mathrm{gr_n_m} - \mathrm{gr_n-2_m+2}), \\ \alpha 26 \times (\mathrm{gr_n_m} - \mathrm{gr_n+1_m+1}) + \beta 26 \times (\mathrm{gr_n_m} - \mathrm{gr_n+2_m+2}), \\ \alpha 27 \times (\mathrm{gr_n_m} - \mathrm{gr_n+1_m-1}) + \beta 27 \times (\mathrm{gr_n_m} - \mathrm{gr_n+2_m-2}), \\ \alpha 28 \times (\mathrm{gr_n_m} - \mathrm{gr_n-1_m-1}) + \beta 28 \times (\mathrm{gr_n_m} - \mathrm{gr_n-2_m-2}) \end{pmatrix} \quad (6)$$

For example, when the pixel 60*n_m* of the m-th column at the n-th row is set to the target pixel, the signal processing unit 22 calculates a difference between the gradation data of the pixel 60*n_m* and the gradation data of two peripheral pixels disposed in each of the horizontal direction, the vertical direction, and the oblique direction with respect to the pixel 60*n_m* set to the target pixel, based on Equation (6). The signal processing unit 22 specifies the maximum value MAX from the calculation results, and sets the maximum value MAX to a correction value CV_n_m for the pixel 60*n_m*.

The signal processing unit 22 determines the correction value CV corresponding to the target pixel, based on a difference between the gradation data of the target pixel and the gradation data of a first peripheral pixel adjacent to the target pixel and a second peripheral pixel adjacent to the first peripheral pixel, among the plurality of pixels 60. The signal processing unit 22 reduces the pixel value of the target pixel by subtracting the correction value CV from the gradation data of the target pixel, thereby decreasing the difference. The pixel value is a gradation value, for example.

That is, the signal processing unit 21 determines the correction value CV corresponding to the target pixel based on the difference between the gradation data of the target pixel and the gradation data of the two peripheral pixels disposed in each of the horizontal direction, the vertical direction, and the oblique direction with respect to the target pixel, among the plurality of pixels 60. Then, the signal processing unit 21 reduces the pixel value of the target pixel by subtracting the correction value CV from the gradation data of the target pixel, thereby decreasing the difference.

In the display device 13 and the display method according to a third embodiment, the signal processing unit 23 calculates the differences between the gradation data of the target pixel and the gradation data of the peripheral pixels disposed in the horizontal direction, the vertical direction, and the oblique direction with respect to the target pixel, based on Equation (7). Then, the signal processing unit 23 specifies the maximum value from the calculation results, and sets the maximum value to the correction value CV for the target pixel.

$$\mathrm{CV_n_m} = \mathrm{MAX}\begin{pmatrix} \alpha 11 \times (\mathrm{gr_n_m} - \mathrm{gr_n-1_m}), \\ \alpha 12 \times (\mathrm{gr_n_m} - \mathrm{gr_n_m+1}), \\ \alpha 13 \times (\mathrm{gr_n_m} - \mathrm{gr_n+1_m}), \\ \alpha 14 \times (\mathrm{gr_n_m} - \mathrm{gr_n_m-1}), \\ \alpha 15 \times (\mathrm{gr_n_m} - \mathrm{gr_n-1_m+1}), \\ \alpha 16 \times (\mathrm{gr_n_m} - \mathrm{gr_n+1_m+1}), \\ \alpha 17 \times (\mathrm{gr_n_m} - \mathrm{gr_n+1_m-1}), \\ \alpha 18 \times (\mathrm{gr_n_m} - \mathrm{gr_n-1_m-1}) \end{pmatrix} \quad (7)$$

For example, when the pixel 60*n_m* of the m-th column at the n-th row is set to the target pixel, the signal processing unit 23 calculates the differences between the gradation data of the pixel 60*n_m* and the gradation data of the peripheral pixels disposed in the horizontal direction, the vertical direction, and the oblique direction with respect to the pixel 60*n_m* set to the target pixel, based on Equation (7). The signal processing unit 23 specifies the maximum value MAX from the calculation results, and sets the maximum value MAX to the correction value CV_n_m for the pixel 60*n_m*.

The signal processing unit 23 determines the correction value CV corresponding to the target pixel based on the differences between the gradation data of the target pixel and the gradation data of the peripheral pixels adjacent to the target pixel, among the plurality of pixels 60. The signal processing unit 23 reduces the pixel value of the target pixel by subtracting the correction value CV from the gradation data of the target pixel, thereby decreasing the differences. The pixel value is a gradation value, for example.

That is, the signal processing unit 23 determines the correction value CV corresponding to the target pixel based on the differences between the gradation data of the target pixel and the gradation data of the peripheral pixels disposed in the horizontal direction, the vertical direction, and the oblique direction with respect to the target pixel, among the plurality of pixels 60. Then, the signal processing unit 23 reduces the pixel value of the target pixel by subtracting the correction value CV from the gradation data of the target pixel, thereby decreasing the differences.

In the display device 14 and the display device according to a fourth embodiment, the signal processing unit 24 calculates the gradation data of the peripheral pixels disposed in the horizontal direction, the vertical direction, and the oblique direction with respect to the target pixel, based on Equation (8). Then, the signal processing unit 24 specifies the maximum value from the calculation results, and sets the maximum value to the correction value CV for the target pixel.

$$CV_n_m = MAX\begin{pmatrix} \alpha 21 \times (gr_n_m - gr_n-1_m), \\ \alpha 22 \times (gr_n_m - gr_n_m+1), \\ \alpha 23 \times (gr_n_m - gr_n+1_m), \\ \alpha 24 \times (gr_n_m - gr_n_m-1), \\ \alpha 25 \times (gr_n_m - gr_n-1_m+1), \\ \alpha 26 \times (gr_n_m - gr_n+1_m+1), \\ \alpha 27 \times (gr_n_m - gr_n+1_m-1), \\ \alpha 28 \times (gr_n_m - gr_n-1_m-1) \end{pmatrix} \quad (8)$$

For example, when the pixel 60*n_m* of the m-th column at the n-th row is set to the target pixel, the signal processing unit 24 calculates the differences between the gradation data of the pixel 60*n_m* and the gradation data of the peripheral pixels disposed in the horizontal direction, the vertical direction, and the oblique direction with respect to the pixel 60*n_m* set to the target pixel, respectively, based on Equation (8). The signal processing unit 24 specifies the maximum value MAX from the calculation results, and sets the maximum value MAX to the correction value CV_n_m for the pixel 60*n_m*.

The signal processing unit 24 determines the correction value CV corresponding to the target pixel based on the differences between the gradation data of the target pixel and the gradation data of the peripheral pixels adjacent to the target pixel, among the plurality of pixels 60. The signal processing unit 24 reduces the pixel value of the target pixel by subtracting the correction value CV from the gradation data of the target pixel, thereby decreasing the differences. The pixel value is a gradation value, for example.

That is, the signal processing unit 24 determines the correction value CV corresponding to the target pixel based on the differences between the gradation data of the target pixel and the gradation data of the peripheral pixels disposed in the horizontal direction, the vertical direction, and the oblique direction with respect to the target pixel, respectively, among the plurality of pixels 60. Then, the signal processing unit 24 reduces the pixel value of the target pixel by subtracting the correction value CV from the gradation data of the target pixel, thereby decreasing the differences.

In the display devices 11 to 14 and the display methods according to first to fourth embodiments, the analog driving method has been exemplified. However, a digital driving method based on a sub-frame scheme may be applied.

What is claimed is:

1. A liquid crystal display device comprising:

a display pixel unit in which a plurality of pixels are arranged in a horizontal direction and a vertical direction; and a signal processing unit configured to set a correction coefficient for each direction including the horizontal direction, the vertical direction, and an oblique direction with respect to a target pixel, corresponding to differences between gradation data of the target pixel and gradation data of peripheral pixels disposed in the horizontal direction, the vertical direction, and the oblique direction with respect to the target pixel, respectively, among the plurality of pixels, and to determine a correction value to be added to or to be subtracted from the target pixel by multiplying the differences by the correction coefficient for each direction.

2. The liquid crystal display device according to claim 1, wherein the signal processing unit calculates the differences specifies the maximum value from the calculation results, and sets the maximum value to the correction value.

3. The liquid crystal display device according to claim 1, wherein the signal processing unit calculates the differences based on the correction coefficients depending on the directions in which the peripheral pixels are disposed with respect to the target pixel or distances between the target pixel and the peripheral pixels.

4. The liquid crystal display device according to claim 1, wherein the signal processing unit sets a larger correction coefficient as the differences are larger.

5. A display method for displaying an image on a liquid crystal display device, the liquid crystal display device including a plurality of pixels arranged in a horizontal direction and a vertical direction, the display method comprising:

setting a correction coefficient for each direction including the horizontal direction, the vertical direction, and an oblique direction with respect to a target pixel, corresponding to differences between gradation data of the target pixel and gradation data of peripheral pixels disposed in the horizontal direction, the vertical direction, and the oblique direction with respect to the target pixel, respectively, among the plurality of pixels; and determining a correction value to be added to or to be subtracted from the target pixel by multiplying the differences by the correction coefficient for each direction.

6. A liquid crystal display device comprising:

a display pixel unit in which a plurality of pixels are arranged in a horizontal direction and a vertical direction; and a signal processing unit configured to set a correction coefficient for each direction including the horizontal direction, the vertical direction, and an oblique direction with respect to a target pixel, corresponding to first differences between gradation data of the target pixel and gradation data of first peripheral pixels adjacent to the target pixel and second differences between the gradation data of the target pixel and gradation data of second peripheral pixels adjacent to the first peripheral pixels, among the plurality of pixels, and to determine a correction value to be added to or to be subtracted from the target pixel by multiplying the first and second differences by the correction coefficient for each direction.

7. The liquid crystal display device according to claim 6, wherein the signal processing unit calculates the first and second difference, specifies the maximum value from the calculation results, and sets the maximum value to the correction value.

8. The liquid crystal display device according to claim 6, wherein the signal processing unit calculates the first and second differences based on the correction coefficients depending on the directions in which the first and second peripheral pixels are disposed with respect to the target pixel or distances between the target pixel and the first and second peripheral pixels.

9. A display method for displaying an image on a liquid crystal display device, the liquid crystal display device including a plurality of pixels arranged in a horizontal direction and a vertical direction, the display method comprising:

setting a correction coefficient for each direction including the horizontal direction, the vertical direction, and an oblique direction with respect to a target pixel, corresponding to first differences between gradation data of the target pixel and gradation data of first peripheral pixels adjacent to the target pixel and second differences between the gradation data of the target pixel and gradation data of second peripheral pixels adjacent to the first peripheral pixels, among the plurality of pixels;

determining a correction value to be added to or to be subtracted from the target pixel by multiplying the first and second differences by the correction coefficient for each direction.

* * * * *